US010695683B2

(12) United States Patent
Hacking

(10) Patent No.: US 10,695,683 B2
(45) Date of Patent: Jun. 30, 2020

(54) ACTION CHARACTER MODELS AND ACCESSORIES WITH MOVABLE PARTS

(71) Applicant: Morphonauts LLC, Riverton, UT (US)

(72) Inventor: Beau Jared Hacking, Riverton, UT (US)

(73) Assignee: Morphonauts LLC, Riverton, UT (US)

( * ) Notice: Subject to any disclaimer, the term of this patent is extended or adjusted under 35 U.S.C. 154(b) by 0 days.

(21) Appl. No.: 16/357,075

(22) Filed: Mar. 18, 2019

(65) Prior Publication Data

US 2019/0209937 A1 Jul. 11, 2019

Related U.S. Application Data

(63) Continuation-in-part of application No. 15/406,127, filed on Jan. 13, 2017, now Pat. No. 10,232,276, which is a continuation-in-part of application No. 14/796,806, filed on Jul. 10, 2015, now Pat. No. 9,566,531.

(60) Provisional application No. 62/022,949, filed on Jul. 10, 2014.

(51) Int. Cl.
*A63H 3/46* (2006.01)
*A63H 9/00* (2006.01)

(52) U.S. Cl.
CPC ..... *A63H 3/46* (2013.01); *A63H 9/00* (2013.01)

(58) Field of Classification Search
CPC ..... A63H 33/00; A63H 33/04; A63H 33/12; A63H 33/26; A63H 33/046; A63H 33/365
USPC ..... 446/92, 97, 99, 102, 139, 376
See application file for complete search history.

(56) References Cited

U.S. PATENT DOCUMENTS

| | | | | |
|---|---|---|---|---|
| 3,090,155 | A | 5/1963 | Gordon | |
| 3,168,227 | A | 2/1965 | Osmond | |
| 3,246,422 | A | 4/1966 | Teagarden | |
| 4,118,888 | A | 10/1978 | Ogawa | |
| 5,746,638 | A | 5/1998 | Shiraishi | |
| 6,033,284 | A | 3/2000 | Rodriguez Ferre | |
| 8,062,088 | B2 | 11/2011 | Perry | |
| 8,888,553 | B2 | 11/2014 | McMullen | |
| 2005/0020179 | A1 | 1/2005 | Pillai | |
| 2005/0112993 | A1 | 5/2005 | Cheng | |
| 2009/0215358 | A1* | 8/2009 | Moothedath | A63H 3/46 446/139 |
| 2013/0165016 | A1 | 6/2013 | Li | |

FOREIGN PATENT DOCUMENTS

| | | | |
|---|---|---|---|
| EP | 1 500 417 | A1 | 1/2005 |
| WO | 2004/018064 | A1 | 3/2004 |

OTHER PUBLICATIONS

Partial International Search Report dated Oct. 19, 2015, issued in PCT Application No. PCT/US2015/040007, filed Jul. 10, 2015.

* cited by examiner

*Primary Examiner* — Kien T Nguyen
(74) *Attorney, Agent, or Firm* — Workman Nydegger

(57) ABSTRACT

An action character assembly includes a torso having a first magnet disposed therein, the torso bounding a first passage extending from an exterior surface of the torso toward the first magnet, the first passage having a non-circular transverse cross sectional configuration. A first appendage has a first connector attached thereto, a portion of the first connector being received within first passage so that the first connector is magnetically coupled to the first magnet, the first connector being movably coupled to the first appendage.

18 Claims, 24 Drawing Sheets

ACTION CHARACTER MODELS AND ACCESSORIES WITH MOVABLE PARTS

CROSS-REFERENCE TO RELATED APPLICATIONS

This application is a continuation-in-part of U.S. application Ser. No. 15/406,127, filed Jan. 13, 2017, which is a continuation-in-part of U.S. application Ser. No. 14/796,806, filed Jul. 10, 2015, which claims benefit to U.S. Provisional Application No. 62/022,949, filed Jul. 10, 2014, which are incorporated herein by specific reference.

BACKGROUND OF THE INVENTION

1. The Field of the Invention

The present invention relates to toy action character assemblies having movable and removable parts and appendages.

2. The Relevant Technology

Toy action characters come in a variety of different configurations and are commonly acquired by youth for collection and play. Many toy action characters are fixed in their design so that no modifications can be made thereto. Such designs permit limited creativity and restrict the ability to adapt the characters to different situations. Other action characters can permit the addition of accessories. Such modifications, however, are typically limited and often incorporate delectate connectors that are easily broken.

Accordingly, what is needed in the art are toy action characters that can be easily and dramatically modified to improve creativity and allow for adaptation of the character to different situations. Furthermore, such toy action characters are needed where the toys are sturdy and the connections between parts is strong so that there is no unintentional separation or failure.

SUMMARY OF THE DISCLOSURE

In one embodiment of the invention, an action character model can include:

- a torso having a first magnet disposed therein, the first magnet having a first side and an opposing second side, the torso bounding a first passage extending from an exterior surface of the torso toward the first side of the first magnet and a second passage extending from the exterior surface of the torso toward the second side of the first magnet;
- a first appendage having a first connector attached thereto, a portion of the first connector being received within first passage so that the first connector is magnetically coupled to the first side of the first magnet; and
- a second appendage having a second connector attached thereto, a portion of the second connector being received within the second passage so that the second connector is magnetically coupled to the second side of the first magnet.

The first passage and the second passage can be disposed on opposing sides of the torso.

The first passage can extend to the first side of the first magnet.

The first connector can be pivotably attached to the first appendage.

The first connector can comprise:

- a rounded head secured to the first appendage;
- a disc being received within first passage of the torso; and
- a neck extending between the rounded head and the disc.

The neck can be constricted relative to the rounded head and the disc.

The first connector can be non-magnetic but be magnetically attracted to the first magnet.

The first connector can be magnetically connected directly to the first side of the first magnet and the second connector can be magnetically connected directly to the second side of the first magnet.

The first appendage and the second appendage can comprise a first leg and a second leg, respectively.

The action character model can further comprise:

- a second magnet disposed within the torso and spaced apart from the first magnet, a third passage extending from the exterior surface of the torso toward second magnet; and
- a third appendage having a third connector attached thereto, a portion of the third connector being received within the third passage so that the third connector is magnetically coupled to the second magnet.

The action character model can further comprise:

- a third magnet disposed within the torso and spaced apart from the first magnet and second magnet, a fourth passage extending from the exterior surface of the torso toward third magnet; and
- a fourth appendage having a fourth connector attached thereto, a portion of the fourth connector being received within the fourth passage so that the fourth connector is magnetically coupled to the third magnet.

The third appendage and the fourth appendage can comprise a first arm and a second arm, respectively.

The action character model can further comprise:

- one or more ribs outwardly projecting from the exterior surface of the torso adjacent to the first passage; and
- one or more ribs outwardly projecting the exterior surface of the first appendage adjacent to the first connector, the one or more ribs of the torso engaging against the one or more ribs of the first appendage so as to at least partially restrain movement of the first appendage relative to the torso.

The first magnet can be a disc magnet. The first magnet can have a cylindrical configuration and the first passage can have a cylindrical configuration.

In another embodiment of the present invention, an action character assembly can comprise:

- a torso having a first magnet disposed therein, the torso bounding a first passage extending from an exterior surface of the torso toward the first magnet; and
- a first appendage having a first connector attached thereto, a portion of the first connector being received within first passage so that the first connector is magnetically coupled to the first magnet, the first connector being non-magnetic.

The torso can comprise a first portion and a second portion that are secured together by one or more fasteners, the first magnet being captured between the first portion and the second portion.

The one or more fasteners can comprise one or more screws.

The first portion and the second portion may not be secured together by an adhesive.

The first connector can be pivotably attached to the first appendage.

The first connector can comprise:

a rounded head secured to the first appendage;

a disc being received within first passage of the torso; and a neck extending between the rounded head and the disc.

The neck can be constricted relative to the rounded head and the disc.

The disc can be rotatable within the first passage.

The rounded head can be press fit into the first appendage.

The rounded head can be rotatable within the appendage.

The first appendage can include:

a socket in which the rounded head of the first connector is received; and a passage that extends between the socket and an exterior surface of the appendage, the passage being larger than the neck of the first connector so that the first connector can pivot on the first appendage.

The disc can be magnetically connected directly to the first magnet.

The first appendage can comprise an arm, leg, head, weapon, or accessory.

The action character assembly can further comprise:

a second magnet disposed within the torso and spaced apart from the first magnet, a second passage extending from the exterior surface of the torso toward second magnet; and a second appendage having a second connector attached thereto, a portion of the second connector being received within the second passage so that the second connector is magnetically coupled to the second magnet.

The action character assembly can further comprise:

one or more ribs outwardly projecting from the exterior surface of the torso adjacent to the first passage; and one or more ribs outwardly projecting the exterior surface of the first appendage adjacent to the first connector, the one or more ribs of the torso engaging against the one or more ribs of the first appendage so as to at least partially restrain movement of the first appendage relative to the torso.

The first magnet can be a disc magnet. The first magnet can have a cylindrical configuration and the first passage can have a cylindrical configuration.

BRIEF DESCRIPTION OF THE DRAWINGS

Various embodiments of the present invention will now be discussed with reference to the appended drawings. It is appreciated that these drawings depict only typical embodiments of the invention and are therefore not to be considered limiting of its scope.

DETAILED DESCRIPTION OF THE PREFERRED EMBODIMENTS

Figure 1:
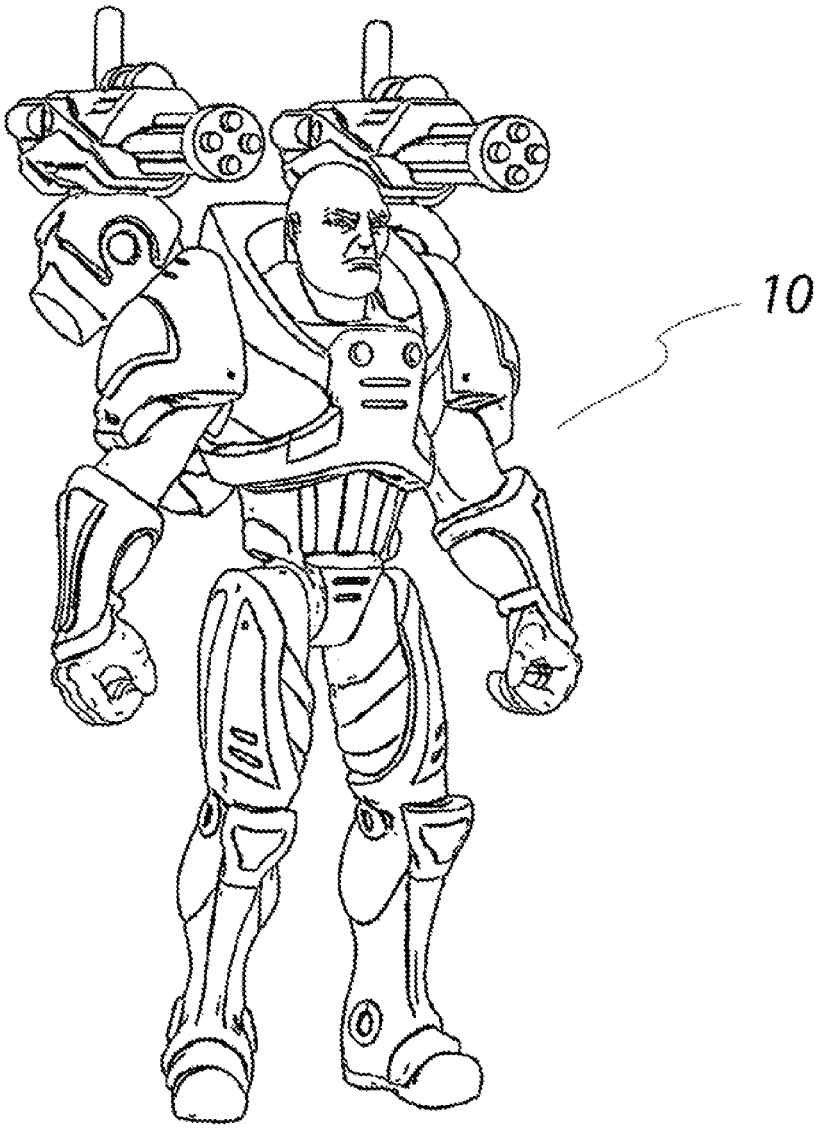
FIG. 1 is a perspective view of a toy action character model.

In the following detailed description, reference is made to the accompanying drawings, which form a part hereof. In the drawings, similar symbols typically identify similar components, unless context dictates otherwise. The embodiments described in the detailed description, drawings, and claims are not meant to be limiting. Other embodiments may be utilized, and other changes may be made, without departing from the spirit or scope of the subject matter presented herein. It will be readily understood that the aspects of the present disclosure, as generally described herein, and illustrated in the Figures, can be arranged, substituted, combined, separated, and designed in a wide variety of different configurations, all of which are explicitly contemplated herein. It will also be understood that any reference to a first, second, etc. element in the claims or in the detailed description is not meant to imply numerical sequence, but is meant to distinguish one element from another unless explicitly noted otherwise.

In addition, as used in the specification and appended claims, directional terms, such as "top," "bottom," "up," "down," "upper," "lower," "proximal," "distal," "horizontal," "vertical," and the like are used herein solely to indicate relative directions and are not otherwise intended to limit the scope of the invention or claims.

In the drawings, like numerals designate like elements. Furthermore, multiple instances of an element may each include separate letters appended to the element number. For example two instances of a particular element "20" may be labeled as "20a" and "20b". In that case, the element label may be used without an appended letter (e.g., "20") to generally refer to every instance of the element; while the element label will include an appended letter (e.g., "20a") to refer to a specific instance of the element.

Figure 2:
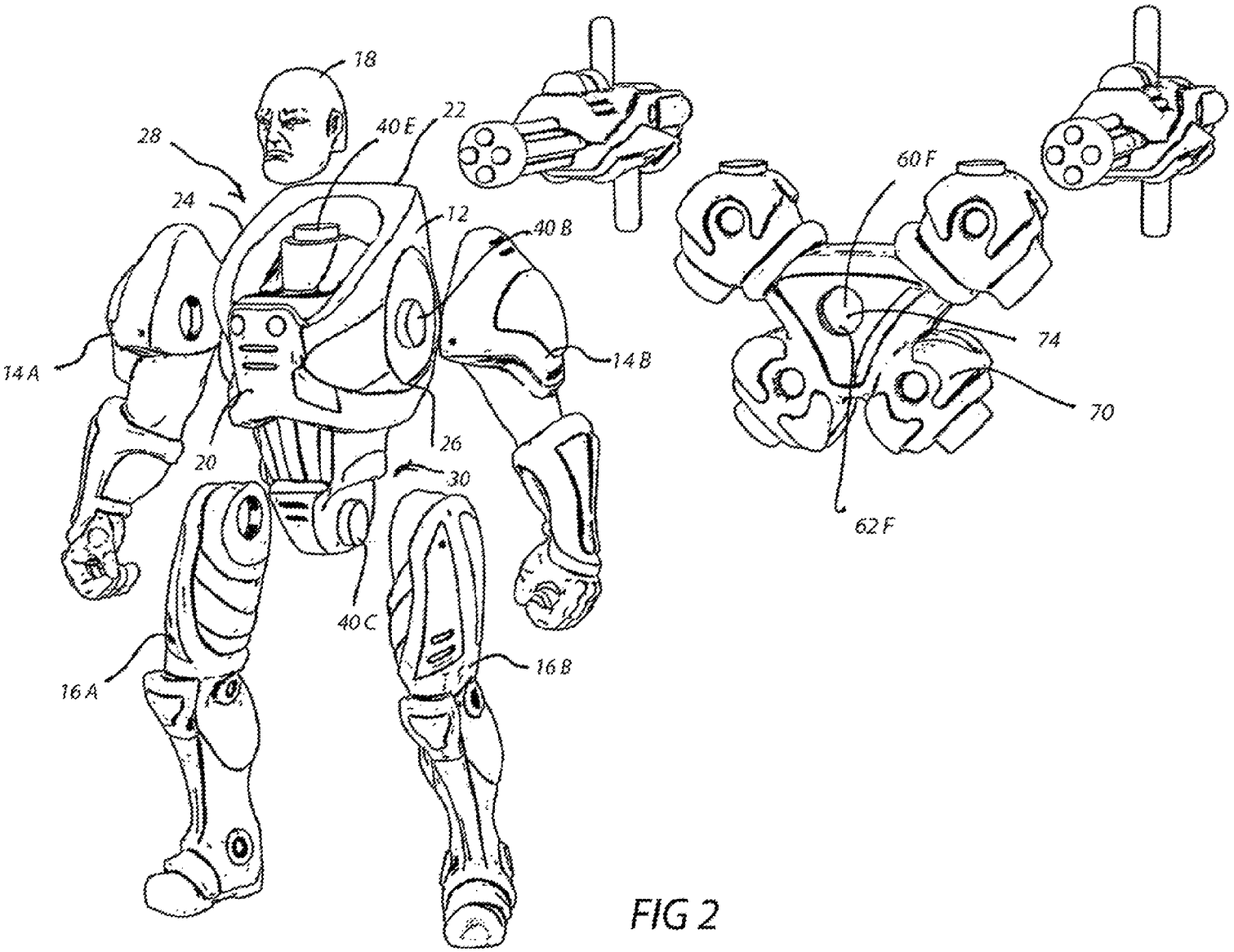
FIG. 2 is an exploded view of the toy action character model shown in FIG. 1.

Depicted in FIG. 1 is one embodiment of an inventive toy action character model 10 incorporating features of the present invention. As depicted in FIG. 2, action character model 10 comprises a torso 12 having a plurality of appendages and accessories that are removably attach thereto. In the embodiment depicted, the appendages can comprise a right arm 14A, a left arm 14B, a right leg 16A, a left leg 16B, and a head 18. As will be discussed below in more detail, it is appreciated that torso 12, arms 14, legs 16, and head 18 can come in a variety of different sizes and configurations and that different accessories can be matched with different torsos to produce action characters 10 having a variety of different configurations. Furthermore, different torsos can be configured to have different numbers and types of appendages that attach thereto. For example, a torso can be configured to attach to one, two, three, four, or six or more appendages to form different appearances and different creatures. The torso, appendages and accessories are typically molded from a plastic or polymer material, such as through injection molding or other molding processes. Other materials and methods of manufacture can also be used. The fully assembled action characters 10 typically have a maximum length in a range between about 5 cm to about 50 cm with about 8 cm and 18 cm being more common. Other dimensions can also be used.

Action character model 10 is configured so that the appendages can be moveable attached to torso 12 and be selectively removable from torso 12. For example, torso 12 comprises a front face 20, an opposing back face 22, a right side 24, and an opposing left side 26 that all extend between an upper end 28 and an opposing lower end 30. Upper end terminates at a top face 29. As better depicted in FIG. 3, openings 32A and 32B are formed on sides 24 and 26, respectively, of torso 12 at upper end 28. Similarly, openings 34A and 34B are formed on opposing sides 24 and 26, respectively, of torso 12 at lower end 30. An opening 36 is also centrally formed on top face 29. In the depicted embodiment, openings 32-36 comprise circular recesses in the form of blind cylindrical sockets. Each opening 32-36 typically has a depth D1 extending from an exterior surface of torso 12 to an inside face 37 that is typically in a range between about 0.1 cm to about 0.5 cm. In other embodiments, the depth of D1 can be greater than, equal to, or less than 0.1 cm, 0.3 cm, 0.5 cm, 0.7 cm or 1 cm or in a range between any two of foregoing. Other dimensions can also be used.

Figure 4:
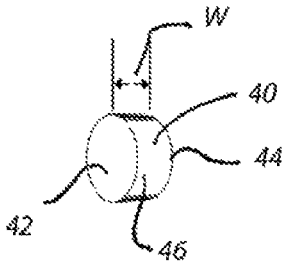
FIG. 4 is a perspective view of a magnet used in the toy action character model shown in FIG. 1.

Each opening 32-36 is configured to receive a first magnet 40. In one embodiment, as depicted in FIG. 4, each first magnet 40 is a disc magnet having a cylindrical configuration that includes a first end face 42 and an opposing second end face 44 that are typically both flat, disposed in parallel alignment, and have opposite poles. A circular sidewall 46 extends between end faces 42 and 44. The width W of first magnet 40 extending between faces 42 and 44 is typically greater than the diameter thereof. In one embodiment, each first magnet 40 has a diameter in a range between about 0.3 cm and about 1.5 cm with about 0.1 cm to about 1 cm being more common and has a width W in a range between about 0.2 cm and about 1 cm with about 0.2 cm to about 0.5 cm being more common. In other embodiments, the diameter of first magnet 40 can be greater than, equal to, or less than 0.1 cm, 0.3 cm, 0.5 cm, 0.7 cm, 1 cm or 1.5 cm or in a range between any two of foregoing while the width W can be greater than, equal to, or less than 0.1 cm, 0.3 cm, 0.5 cm, 0.7 cm, 1 cm or 1.5 cm or in a range between any two of foregoing with the width typically being greater than the diameter but not required. Other dimensions can also be used.

Figure 5:
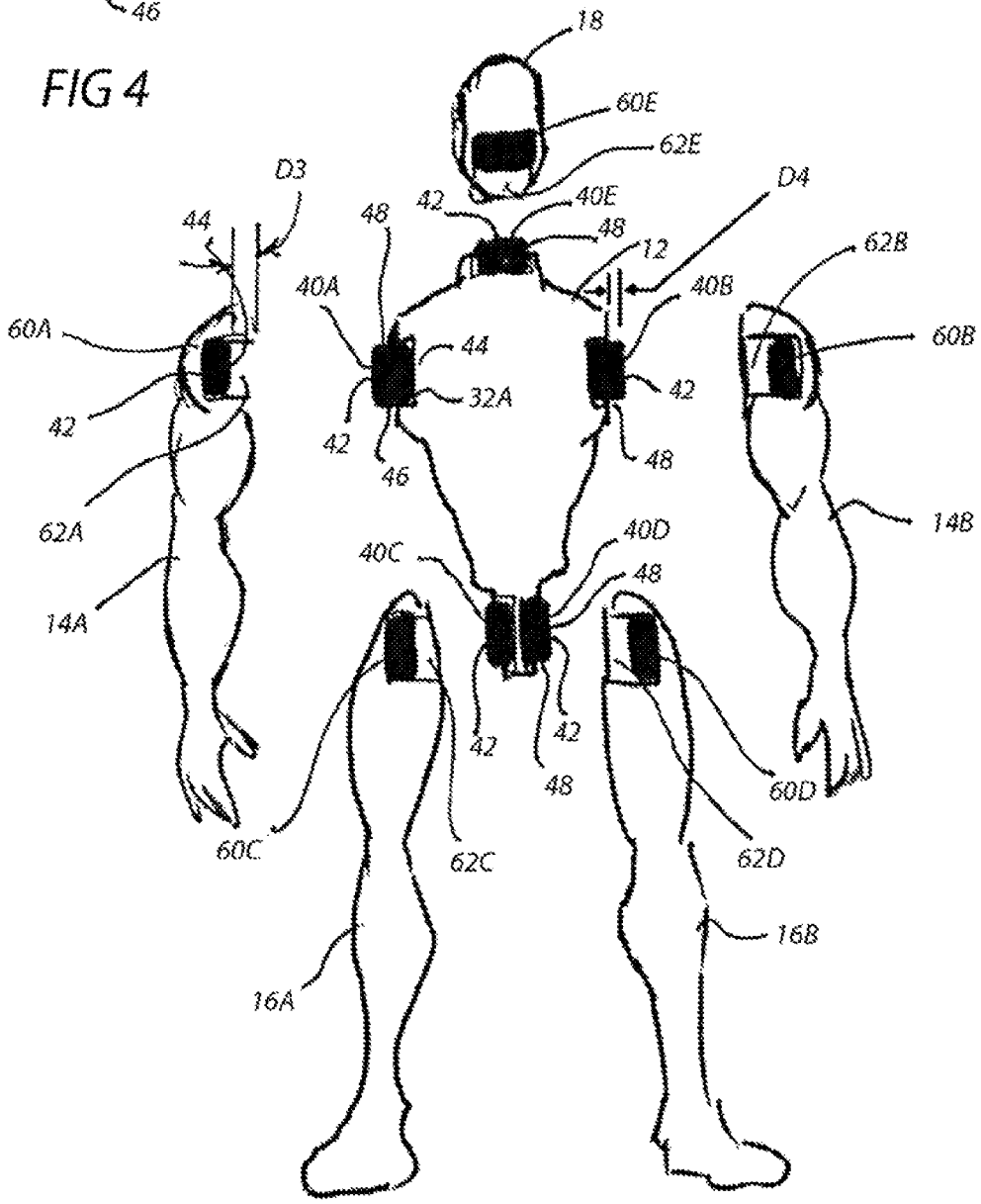
FIG. 5 is the schematic view shown in FIG. 3 showing the magnet in FIG. 4 within the openings on the torso and appendages.

As depicted in FIG. 5, a separate first magnet 40A-40E is received and secured within a corresponding one of openings 32-36. First magnets 40 and openings 32-36 can be of complementary diameter and first magnets 40 can be secured within opening 32-36 by an adhesive, welding, press-fit, over-molding, or using other conventional techniques. In one embodiment, width W of first magnets 40 is greater than the depth D1 of openings 32-36 in which they are received. Accordingly, when first magnets 40A-E are received within openings 32-36, end face 44 is disposed within openings 32-36, end face 42 is openly exposed outside of openings 32-36, and a cylindrical engaging portion 48 (comprising a portion of side wall 46) outwardly projects from the exterior surface of torso 12. The width of engaging portion 48 extending from the exterior surface of torso 12 to end face 42, i.e., distance D4, is typically in a range between about 0.1 cm and about 0.5 cm, although other dimensions can also be used. In other embodiments, the width of engaging portion 48 can be greater than, equal to, or less than 0.1 cm, 0.3 cm, 0.5 cm, or 0.7 cm, or in a range between any two of foregoing.

Magnets 40 can be made of a variety of different materials. Examples of magnets that can be used include neodymium disc and cylinder rare earth magnets. Other materials and types of magnets can also be used. Magnets 40 are typically high strength magnets having a pull force of at least 2 pounds (0.9 kilograms (kg)), 2.5 pounds (1.1 kg), 3 pounds (1.4 kg), 3.5 pounds (1.6 kg), 4 pounds (1.4 kg) or 4.5 pounds (2.0 kg) or in a range between any two of the foregoing. Other strengths can also be used. The pull force can be measured as the pull force needed to remove a magnet 40 from a thick, ground, flat steel plate as is known in the art.

Engaging portion 48 of first magnets 40 are used for attaching the appendages 14-18 to torso 12. Specifically, returning to FIG. 3, each appendage 14-18 also has an opening formed thereon. For example, arms 14A and B have openings 52A and B formed thereon; legs 16A and B have openings 54A and B formed thereon; and head 18 has an opening 56 formed thereon. Openings 52-56 are also circular recesses that form cylindrical blind sockets having a depth D2 extending from an exterior surface of each appendage 14-18 to an inside face 58. Openings 52-56 have a size and configuration similar to openings 32-36 except that the depth D2 of openings 52-56 is typically greater than the depth D1 of openings 32-36 by an amount in a range between 0.1 cm and 0.5 cm. Other dimensions can also be used. In other embodiments, the depth D2 can be greater than the depth D1 by an amount greater than, equal to, or less than 0.1 cm, 0.3 cm, 0.5 cm or 0.7 cm or in a range between any two of foregoing. The depth of D2 can be greater than, equal to, or less than 0.1 cm, 0.3 cm, 0.5 cm, 0.7 cm, 1 cm or 1.5 cm or in a range between any two of foregoing.

As depicted in FIG. 5, second magnets 60A-E are disposed within corresponding openings 52-56. Second magnets 60 can also be disc magnets and can have the same size, configuration, pull force, composition, and other properties as first magnets 40 as discussed above. As such, like elements between first magnets 40 and second magnets 60 are identified by like reference characters. Second magnets 60A-E are positioned within openings 52-56 so that second end face 44 is openly exposed within openings 52-56. End face 42 of first magnets 40 and end face 44 of second magnets 60 are of opposite pole so that they magnetically attract each other. Second magnets 60A-E can be secured within openings 52-56 using the same technique used to secure first magnets 40 within openings 32-36 as discussed above. Because of the increased depth D2 of openings 52-56, when second magnets 60 are fully received and secured within openings 52-56, as shown in FIG. 5, a recessed socket 62A-E is formed extending from end face 44 of second magnets 60A-E to the exterior surface of the corresponding appendage 14-18. Recessed sockets 62A-E typically have a depth D3 in a range between about 0.1 cm to about 0.5 cm but other dimensions can also be used. In other embodiments, the depth of D3 can be greater than, equal to, or less than 0.1 cm, 0.3 cm, 0.5 cm, 0.7 cm or 1 cm or in a range between any two of foregoing. Each recessed socket 62A-E has a configuration complementary to exposed engaging portion 48 of first magnets 40 so that engaging portions 48 can be received within a corresponding recessed socket 62A-E.

Receiving engaging portions 48 within recessed sockets 62 facilitates movable and removable engagement between appendages 14-18 and torso 12. That is, when an engaging portion 48 is received within a recessed socket 62 a combination of a light friction fit therebetween and the magnetic attraction between the first magnet 40 and corresponding second magnet 60 facilitates a secure but yet releasable engagement between the appendage and torso 12. As such, the assembled action character model 10 can be moved and played without unwanted separation between the appendage and torso 12. In the assembled configuration, opposing faces 42 and 44 of magnets 40 and 60 can be directly touching each other or be sufficiently close to achieve the desired magnetic attraction.

Depending on the size of the magnets used, the desired attachment can be achieved without producing any friction fit between engaging portion 48 and the recessed socket 62 in which it is received. As such the difference between the diameter of engaging portion 48 and recessed socket 62 can be greater than, equal to, or less than 0.1 mm, 0.5 mm, 1 mm, or 2 mm, or in a range between any two of foregoing. Other dimensions can also be used. Furthermore, because both engaging portion 48 and recessed socket 62 have complementary circular configurations, the appendage can be freely rotated on torso 12 by engaging portion 48 rotating within recessed socket 62. Where further mobility of the appendage is desired, the appendage can be formed with one or more joints thereof. For example, arms 14 could be formed with joints at the wrist, elbow and/or shoulder. Similar joints can also be formed on legs 16.

Figure 3:
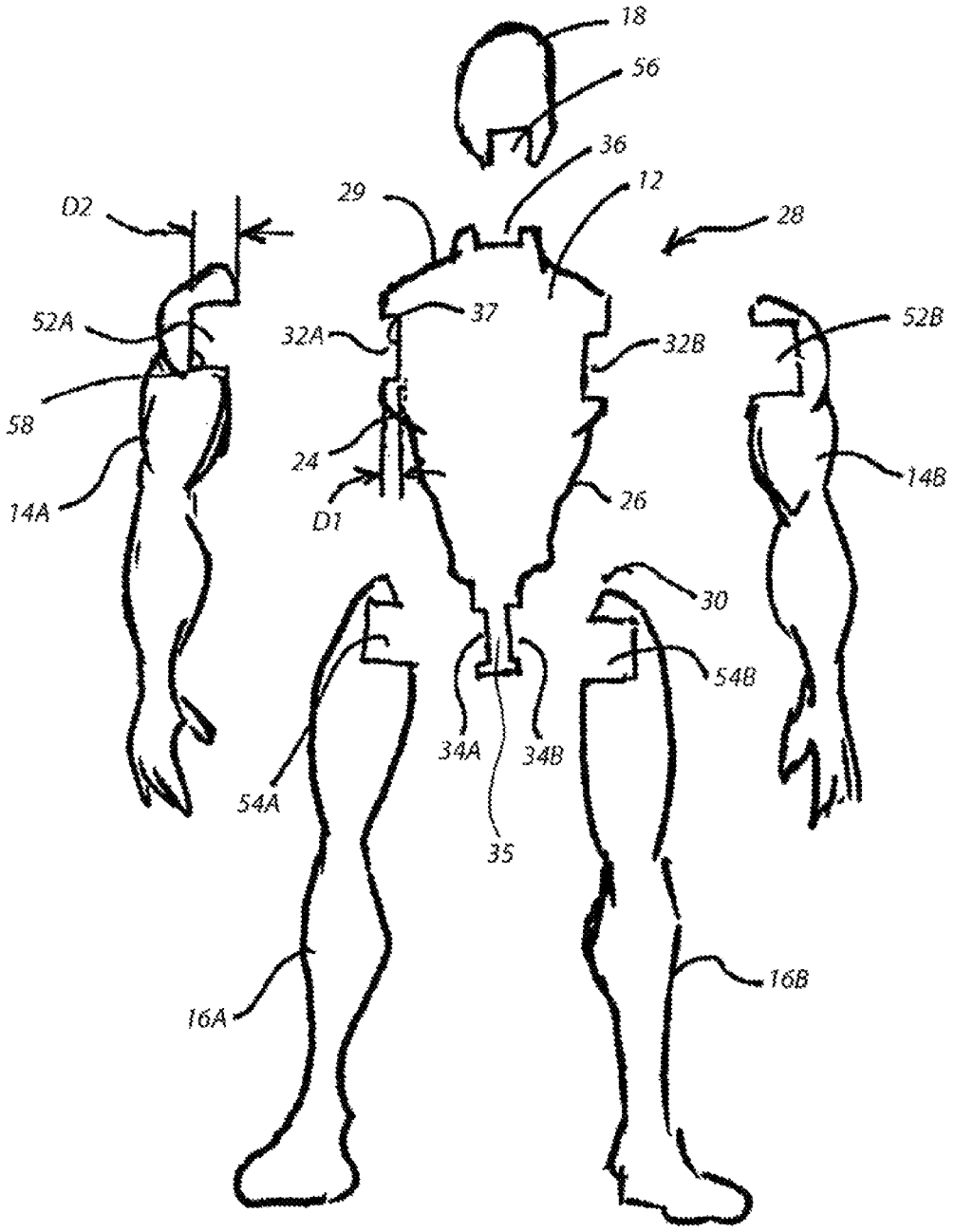
FIG. 3 is a partially cut away schematic view of the torso and appendages of the toy action character model shown in FIG. 1 showing openings thereon.

In the embodiment depicted, action character model 10 is formed so that engaging portions 48 are formed on torso 12 and recessed sockets 62 are formed on appendages 14, 16, and 18. This design provides some unique benefits. For example, as depicted in FIG. 3, at the lower end of torso 12 where legs 16A and 16B attach is a thin groin member 35 formed between openings 34A and 34B. Groin member 35 typically has a thickness between openings 34A and 34B that is greater than, equal to, or less than 0.1 cm, 0.3 cm, 0.5 cm, 0.7 cm, 1 cm or 1.5 cm or in a range between any two of foregoing. Other dimensions can also be used. Groin member 35 is thin so that action character model 10 is proportional when legs 16A and 16B are attached thereto. However, to maximize the thickness of groin member 35 for strength, shallow openings 34A and 34B are formed on opposing sides of groin member 35 as opposed to deeper openings 54A and 54B. That is, if openings 34A and 34B were replaced with openings 54A and 54B, respectively, so that engaging portions 48 were formed on legs 16A and 16B and recessed sockets 62 were formed on torso 12 (FIG. 5), groin member 35 could be so thin as to be structurally unstable or may even be too thin to accommodate openings 54A and 54B for a desired sized action character model 10. In alternative embodiments, however, such as where action character model 10 is larger, engaging portions 48 can be formed on appendages 14, 16, and 18 and recessed sockets 62 can be formed on torso 12.

Figure 12:
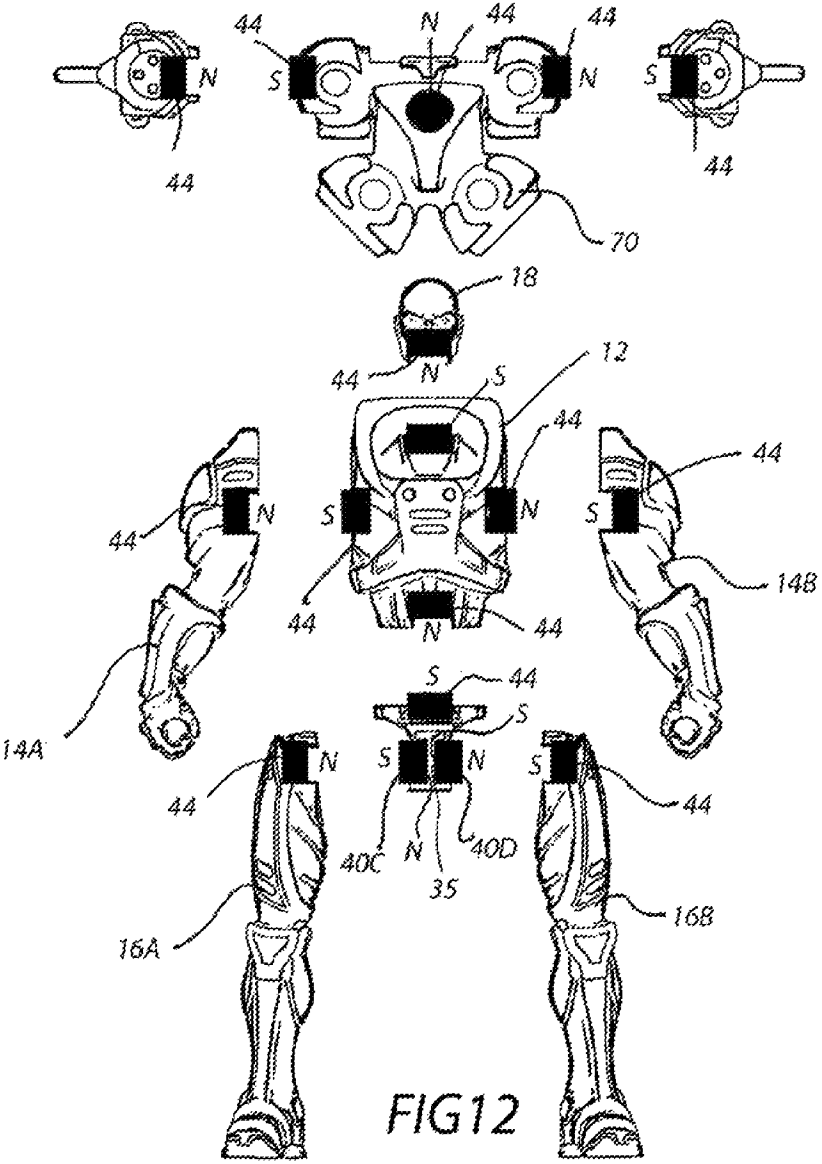
FIG. 12 is a partial cross sectional side view of the toy action character model shown in FIG. 1 showing the orientation of magnetic poles on the magnets.

The configuration of groin member 35 also influences the orientation of magnets 40 and 60. For example, because groin member 35 is so thin and the magnets have a strong pull force, magnets 40C and 40D are orientated, as depicted in FIG. 12, so that their adjacent opposing faces have opposite poles. As a result, the attraction of the magnets through groin member 35 assists to hold magnets 40C and 40D firmly against the opposing sides of groin member 35. In contrast, if the adjacent opposing faces of magnets 40C and 40D were the same poles, magnets 40C and 40D would repulse each other making it very difficult to secure magnets 40C and 40D to the opposing sides of groin member 35. Because the opposing inside faces of magnets 40C and 40D have opposite poles, the opposite outside faces of magnets 40C and 40D also have opposite poles. As a result, this dictates how magnets are orientated on legs 16A and 16B to facilitate magnetic attraction. For consistency in manufacture and assembly of parts, it can be beneficial that all of the magnets 40 on torso 12 form engaging portions 48.

Figure 6:
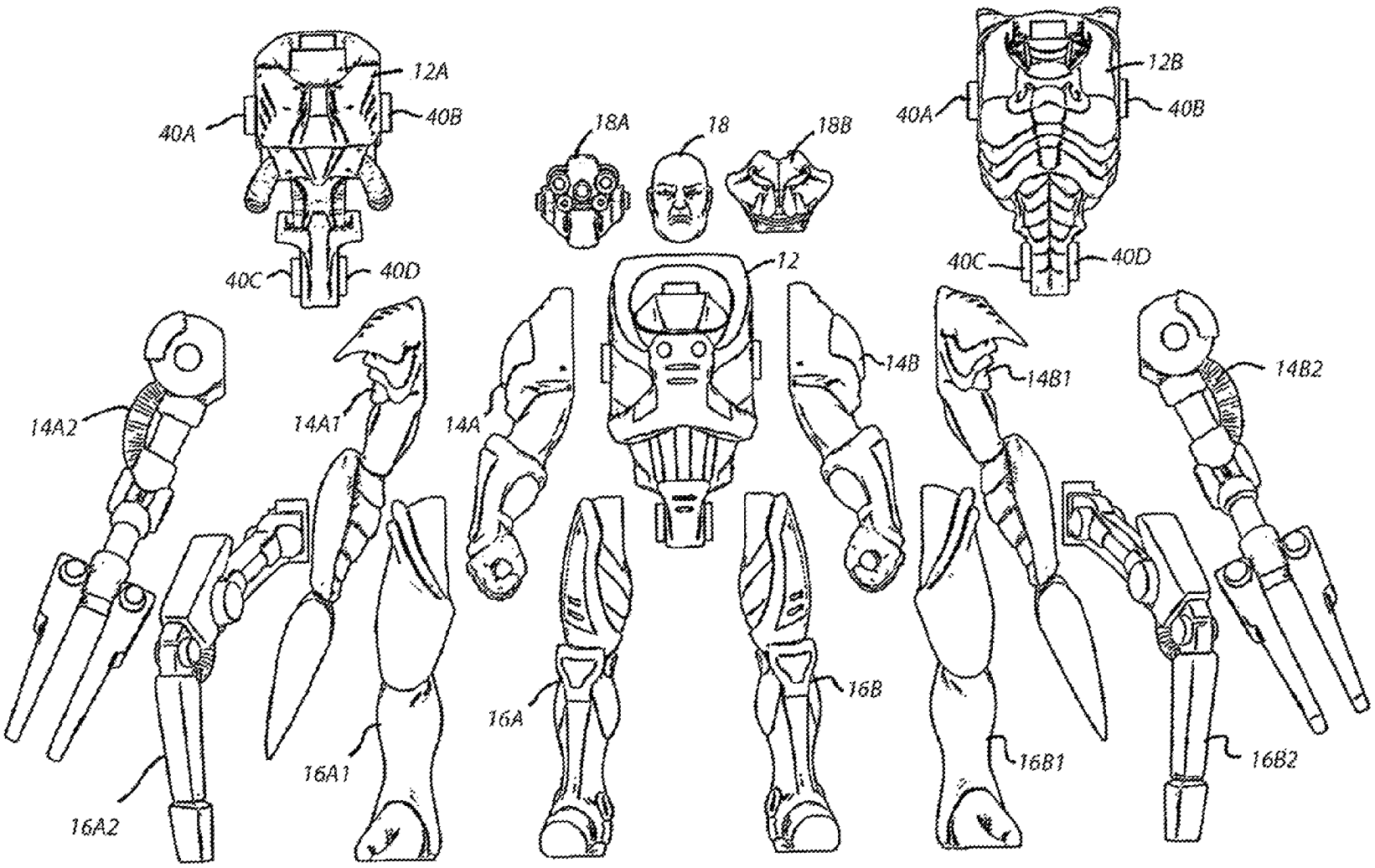
FIG. 6 is an exploded front elevational view the toy action character model shown in FIG. 1 with alternative torsos and appendages that can be used.
Figure 7:
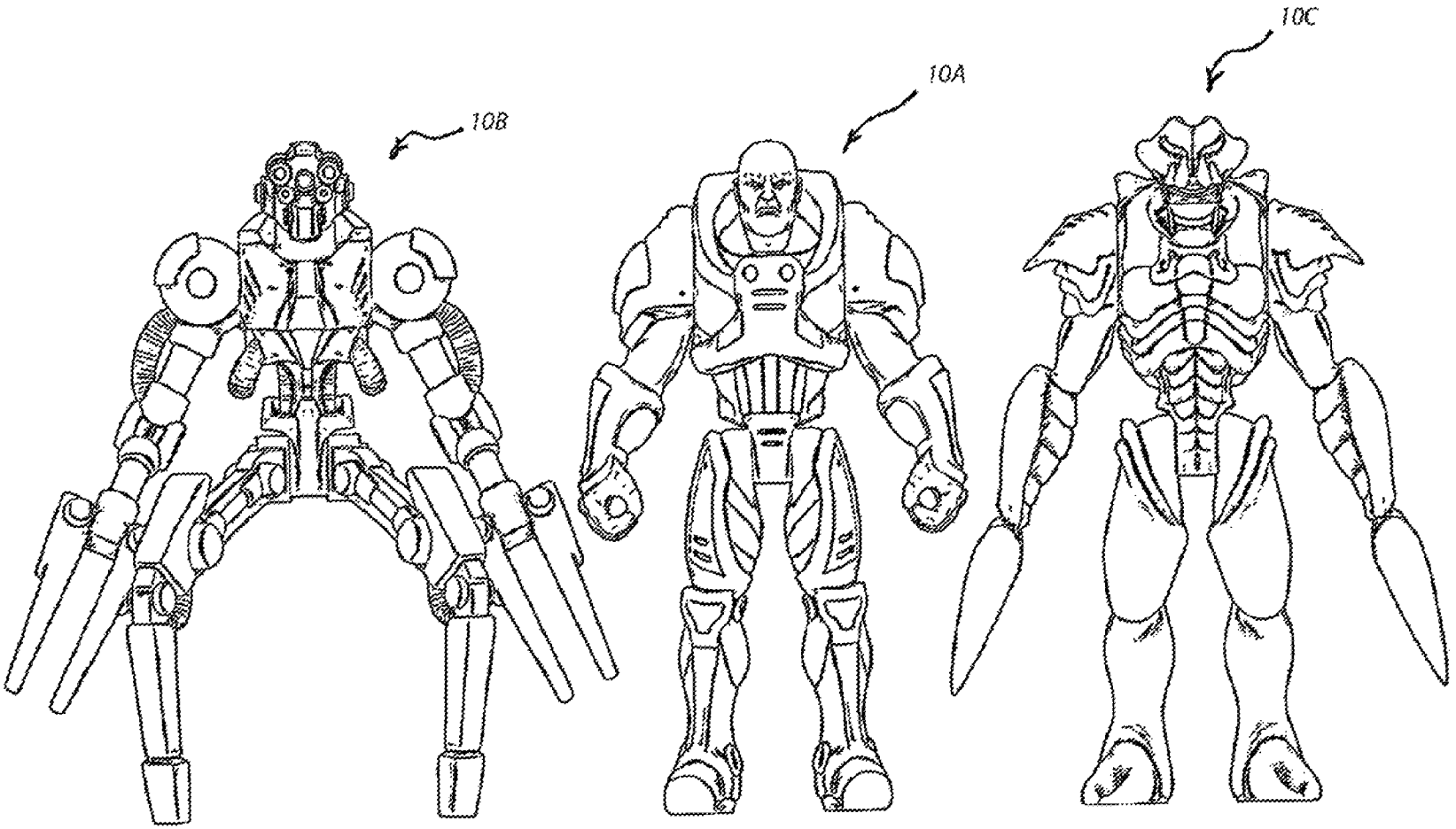
FIG. 7 is a front perspective view of alternative toy action character models that can be made from the parts shown in FIG. 6.

In alternative embodiments, however, such as where action character 10 is larger thereby resulting in groin member 35 being thicker and thus magnets 40C and 40D producing a less attractive or repulsive force on each other, magnets 40C and 40D could be orientated so that there opposing inside faces have the same pole. In turn, this would influence the orientation of the other magnets 40 and 60. As previously mentioned and as depicted in FIG. 6, torso 12 and each of appendages 14-18 can come in a variety of different configurations. For example, as depicted in FIG. 6, torso 12 can be replaced with torso 12A or 12B which also includes first magnets 40. Similarly, right arm 14A can be replaced within arm 14A1 or 14A2; left arm 14B can be replaced with within arm 14B1 or 14B2; right leg 16A can be replaced within leg 16A1 or 16A2; left leg 16B can be replaced with leg 16B1 or 16B2; and head 18 can be replaced with head 18A or 18B. All parts can be easily mixed and matched to form a variety of different action characters such as actions characters 10A, 10B, and 10C as shown in FIG. 7 or mixed combinations thereof. All appendages are easily removably attached using the magnet assembly as discussed above with regard to FIG. 5.

Figure 8:
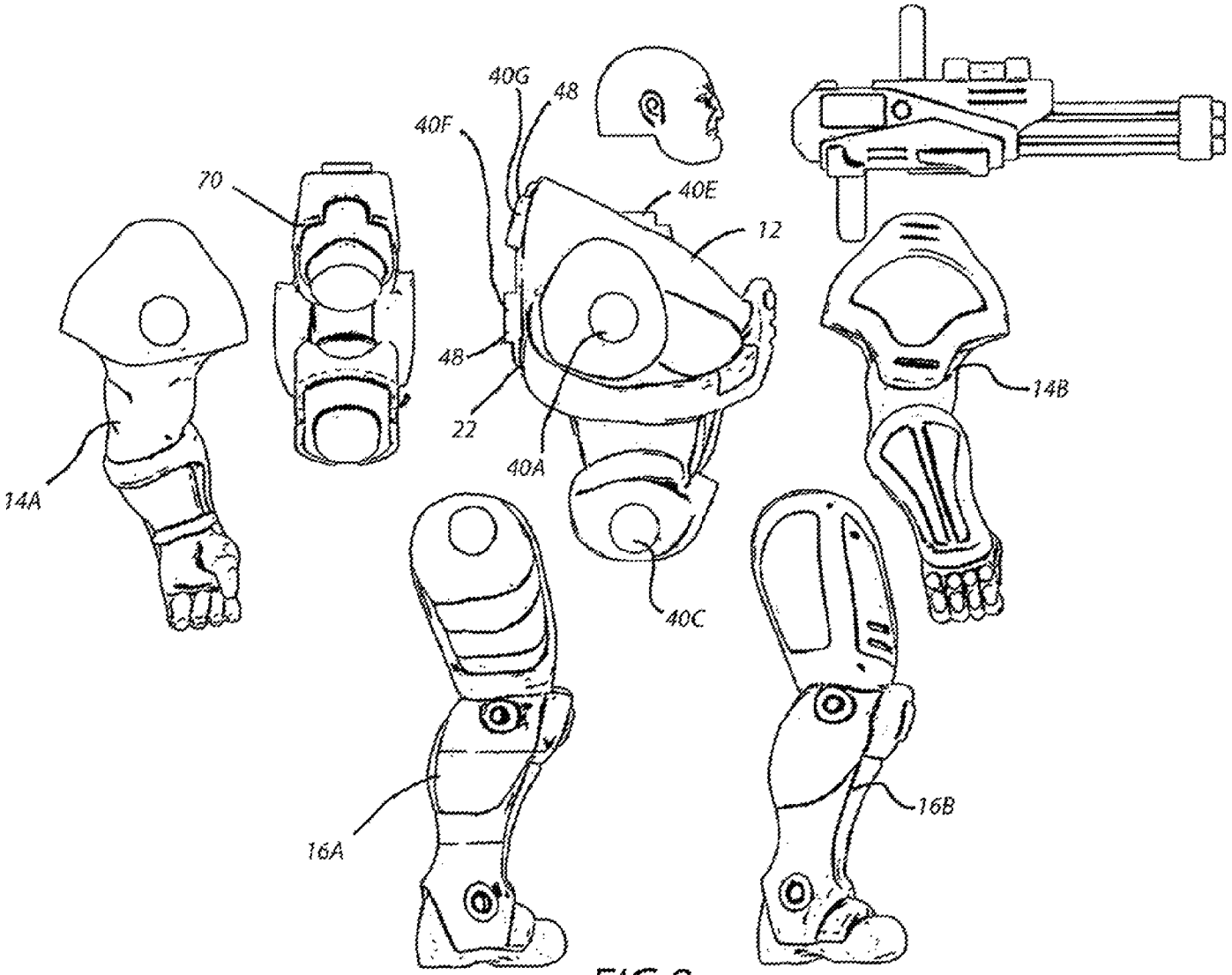
FIG. 8 is an exploded elevational side view of the toy action character model shown in FIG. 1.

Returning to FIG. 2, an accessory 70 such as a backpack, armament, shield, armor, clothing, or any other type of accessory can also be attached to torso 12 or any of appendages 14-18. Accessories 70 are attached to torso 12 or appendages 14-18 in the same way as discussed above that appendages 14-18 are attached to torso 12. For example, accessory 70 in FIG. 2 is shown having a cylindrical opening 74 formed thereon with a second magnet 60F secured therein so that a recessed socket 62F is formed on top thereof. In turn, as depicted in FIG. 8, first magnets 40F and 40G are secured on back surface 22 of torso 12 with the engaging portion 48 thereof outwardly projecting from torso 12 so that accessory 70 can be securely removably secured to torso 12 by one of engaging portions 48 of first magnets 40F or 40G being received within recessed socket 62F of accessory 70.

In alternative embodiments, as previously discussed, it is appreciated that the configuration of the mechanical/magnetic attachment between torso 12 and the appendages and accessories can be reversed. For example, rather than have engaging portions 48 of first magnets 40 outwardly projecting on torso 12, engaging portions 48 of first magnets 40 can be outwardly projecting on each of the appendages and accessories while second magnets 60 can be recessed on torso 12 with recessed sockets 62 formed above second magnets 60 to receive engaging portions 48 of first magnets 40.

Figure 9:
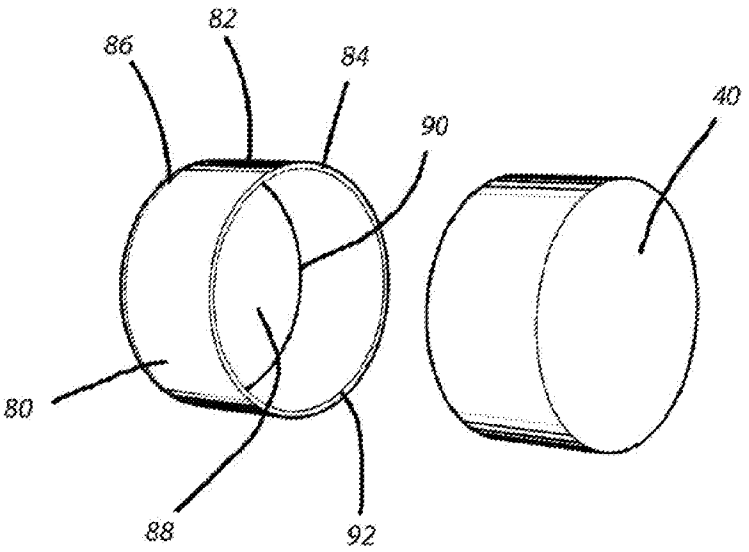
FIG. 9 is a perspective of a retainer that can be used in conjunction with a magnet of the toy action character model shown in FIG. 1.

As previously mentioned, torso 12, appendages 14, 16, and 18 and accessories 70 are typically made from a polymeric material. Examples of polymeric materials that can be used include polyethylene, polypropylene, polystyrene, polyvinylchloride (PVC), and acrylonitrile butadiene styrene (ABS). Other polymers can also be used. To assist in more firmly securing magnets 40, 60 to torso 12, appendages 14, 16, and 18 and/or accessories 70, so that magnets 40, 60 do not unintentionally separate therefrom, magnets can be at least partially enclosed or bounded by a retainer that is secured to torso 12, appendages 14, 16, and 18 and/or accessories 70. For example, depicted in FIG. 9 is one example of a retainer 80 in the form of a cap. Retainer 80 includes a cylindrical tubular sleeve 82 extending between a first end 84 and an opposing second end 86. Disposed at second end 86 of sleeve 82 is a circular end face 88. An interior surface of sleeve 82 and end face 88 bounds a pocket 90 that is cylindrical and at least generally complementary to magnet 40 so that magnet 40 can be received therein. An access opening 92 if formed at first end 84 of sleeve 82 through which magnet 40 can be positioned within pocket 90.

Figure 10:
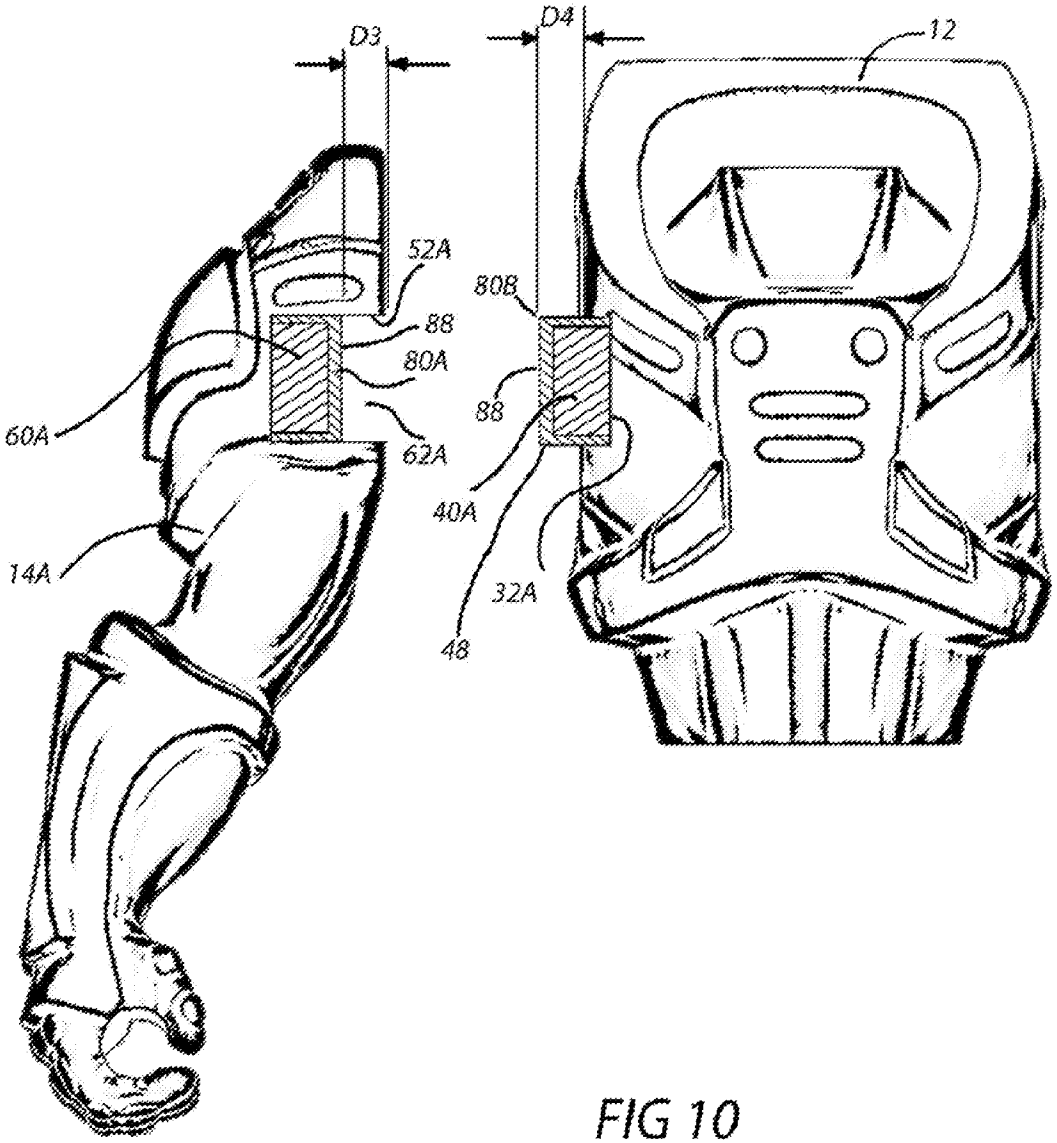
FIG. 10 is a partial cross sectional side view of the toy action character model using the retainers of FIG. 9 to retain the magnets.

During use magnet 40 or 60 is received within pocket 90 of retainer 80 and the combined magnet 40, 60 and retainer 80 are received within one of the openings on action character model 10. For example, as depicted in FIG. 10, a retainer 80A holding magnet 60A is received within opening 52A on arm 14A so that magnet 60A is captured between retainer 80A and arm 14A. Retainer 80A can be configured to form a loose or snug friction fit within opening 52A. Once retainer 80A is positioned within 52A, retainer 80A can be welded to arm 14A such as by sonic welding, heat welding, or other conventional welding techniques. Retainer 80A and the other retainers 80 discussed herein are also typically made of a polymeric material that is either the same as the material in which retainer 80 is being inserted, e.g., the material of arm 14A, or is made of a material that is compatible for welding with the material in which retainer 80 is being inserted so that when retainer 80A is welded to arm 14A, a strong bond is formed between retainer 80A and arm 14A to further prevent unwanted separation between magnet 60A and arm 14A. That is, a weld bond between compatible plastics will typically be greater than conventional bonds between a magnet and a plastic. In this configuration, recessed socket 62A is still formed extending from the exterior surface of arm 14A to end face 88 of retainer 80A. Recessed socket 62A can still have the same depths D3 as previously discussed.

In like manner, a retainer 80B can house magnet 40A and be received within opening 32A of torso 12 and welded to torso 12. Retainer 80B thus also assists in further securing magnet 40A to torso 12. As illustrated in FIG. 10, the combination of retainer 80B and magnet 40A still forms outwardly projecting engaging portion 48 that can be received within recessed socket 62A. The engaging portion 48 has a width D4 that extends from the exterior surface of torso 12 to end face 88 and can have the same dimensions as D4 previously discussed. To account for the use of retainers 80, the diameter and/or depth of the various openings on can be increased on torso 12, appendages 14, 16, and 18 and accessories 70. Retainers 80 typically have a thickness at sleeve 82 and end face 88 greater than, equal to, or less than 1 mm, 1.5 mm, 2 mm, or 2.5 mm, or in a range between any two of foregoing. Other dimensions can also be used.

Figure 11B:
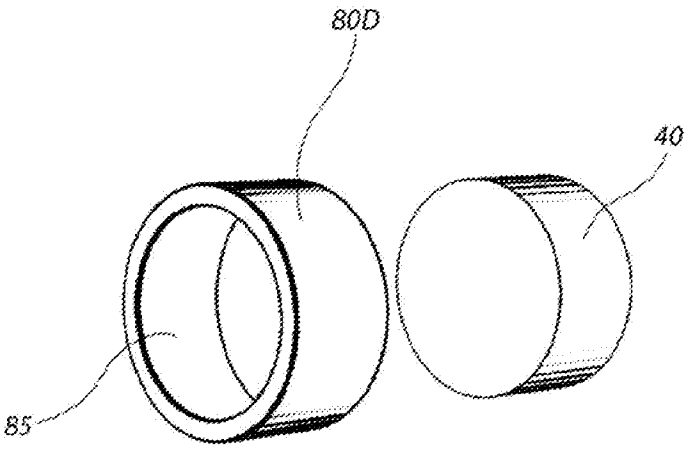
FIGS. 11A and 11B are perspective views of alternative embodiments of the retainer shown in FIG. 9.
Figure 11A:
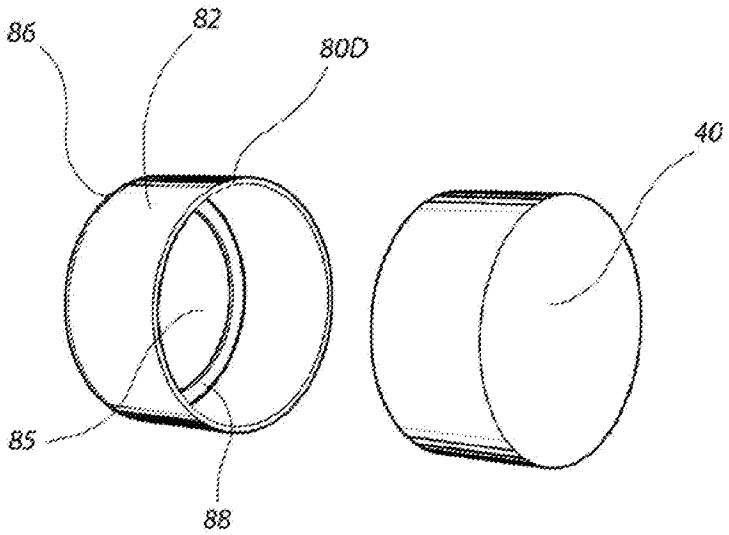

As before, with engaging portion 48 received within recessed socket 62A a magnetic coupling is formed between magnets 40 and 60 while engaging portion 48 can rotate within recessed socket 62A. Here it is noted that magnets 40 and 60 need not be cylindrical but could have other transverse cross sectional areas such as polygonal, oval, irregular or others as long as recessed socket 62A and the exposed engaging portion 48 have configuration that permits the exposed engaging portion 48 to rotate within recessed socket 62A. Likewise, retainers 80 need not cover all of magnets 40 and 60. That is, multiple holes could be formed through retainers 80 as long as there is sufficient structure to securely retainer magnets 40 and 60. For example, depicted in FIGS. 11A and 11B is a retainer 80E. Like elements between retainers 80 and 80E are identified by like reference characters. Retainers 80 and 80E are the same except that a hole 85 is formed through end face 88 so that all that remains of end face 88 is an inwardly projecting flange 87. Flange 87 prevents magnet 40 from passing through retainer 80E.

Figure 11C:
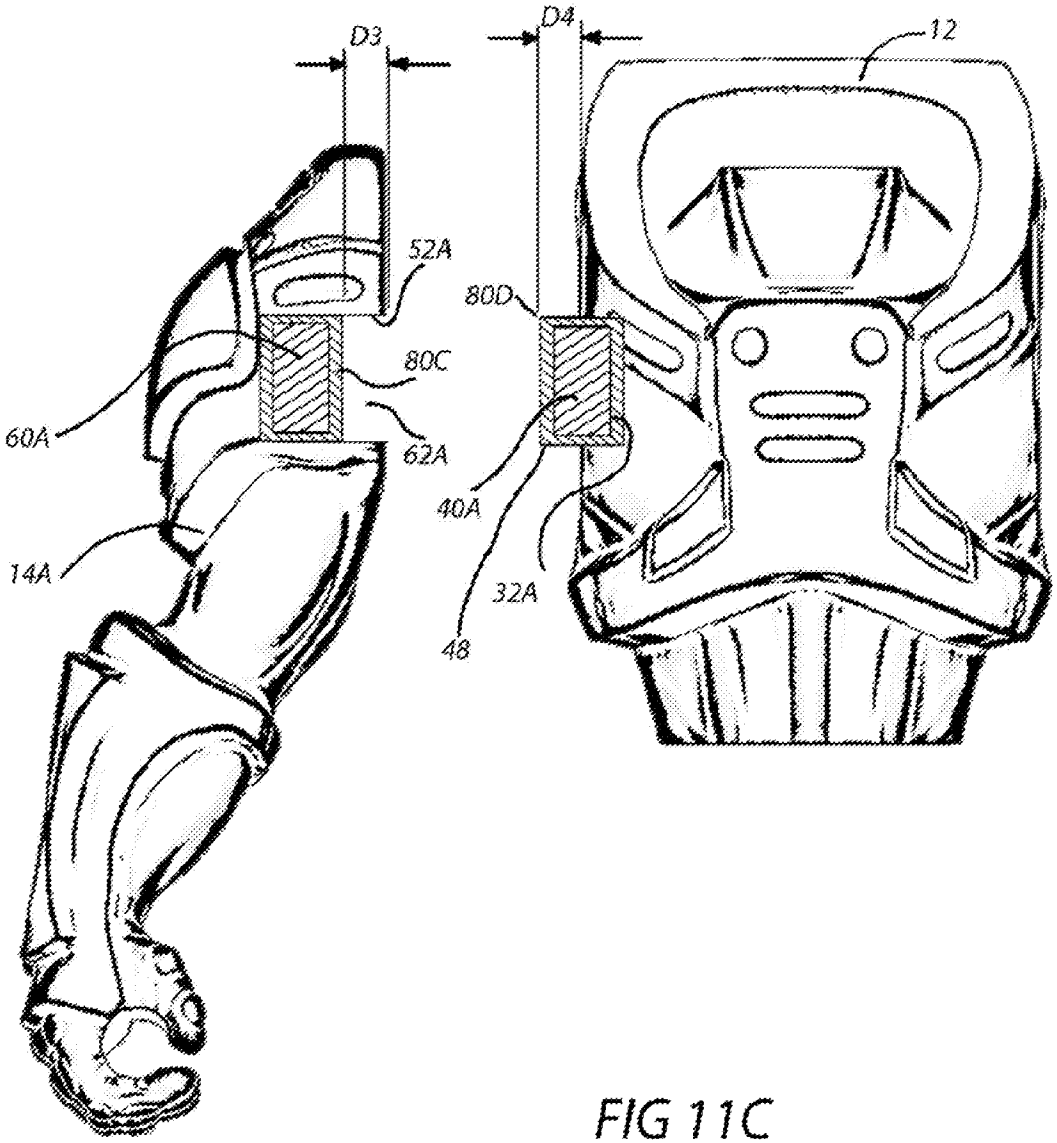
FIG. 11C is a partial cross sectional side view of the toy action character model using alternative retainers to retain the magnets.

In contrast to retainers 80 forming an open cap that receives magnets 40, 60, as discussed above, retainers 80 can also form an enclosure that completely encircles magnet 40, 60. For example, as depicted in FIG. 11C, a retainer 80C is shown having cylindrical configuration that completely encircles magnet 60A and is received in opening 52A of arm 14A while a retainer 80D having the same configuration as retainer 80C completely encircles magnet 40A and is received within opening 32A on torso 12. Again, retainers 80C and 80D can be comprised of a plastic material and welded to arm 14A and torso 12. Other configurations of retainers 80 can also be used. For examples, retainer 80 could comprise plates, plugs, sheets, or other configurations that can be welded to torso 12, appendages 14, 16, and 18 and/or accessories 70 for securing magnets 40, 60. In still other embodiments, magnets 40, 60 can be over molded on torso 12, appendages 14, 16, and 18 and/or accessories 70. In that embodiment, the portion of the over molding cover magnets 40, 60 can be considered the retainer.

In like manner to the above, retainers 80 can also be used for securing magnets 40 and 60 within each of the other openings on torso 12, appendages 14, 16, and 18 and/or accessories 70. In addition, when retainers 80 are used, engaging portion 48 on torso 12 can be switched with recessed socket 62A on appendages 14, 16, and 18 and/or accessories 70.

The foregoing assembly for the toy action character model has a number of unique advantages. For example, the assembly makes it easy to attach, remove, and switch appendages and accessories from the torso to make multiple difference characters. The appendages and accessories attached to the torso can be easily and smooth moved for manipulating the character without unwanted separation of the parts. Furthermore, manufacture of the torso, appendages and accessories is simple and the resulting product is sturdy with no delicate parts that are easily broken. Other advantages also exist.

As previously discussed, to facilitate magnet coupling between adjacent magnets 40 and 60, the opposing faces on adjacent magnets 40 and 60 are positioned to have opposite poles. For example, FIG. 12 depicts action character model 10 in a partially exploded view where the poles of opposing faces of magnets 40 and 60 are shown as having either a north pole ("N") or a south pole ("S"). In an alternative embodiment, the designated poles could be reversed.

Figures 13, 14:
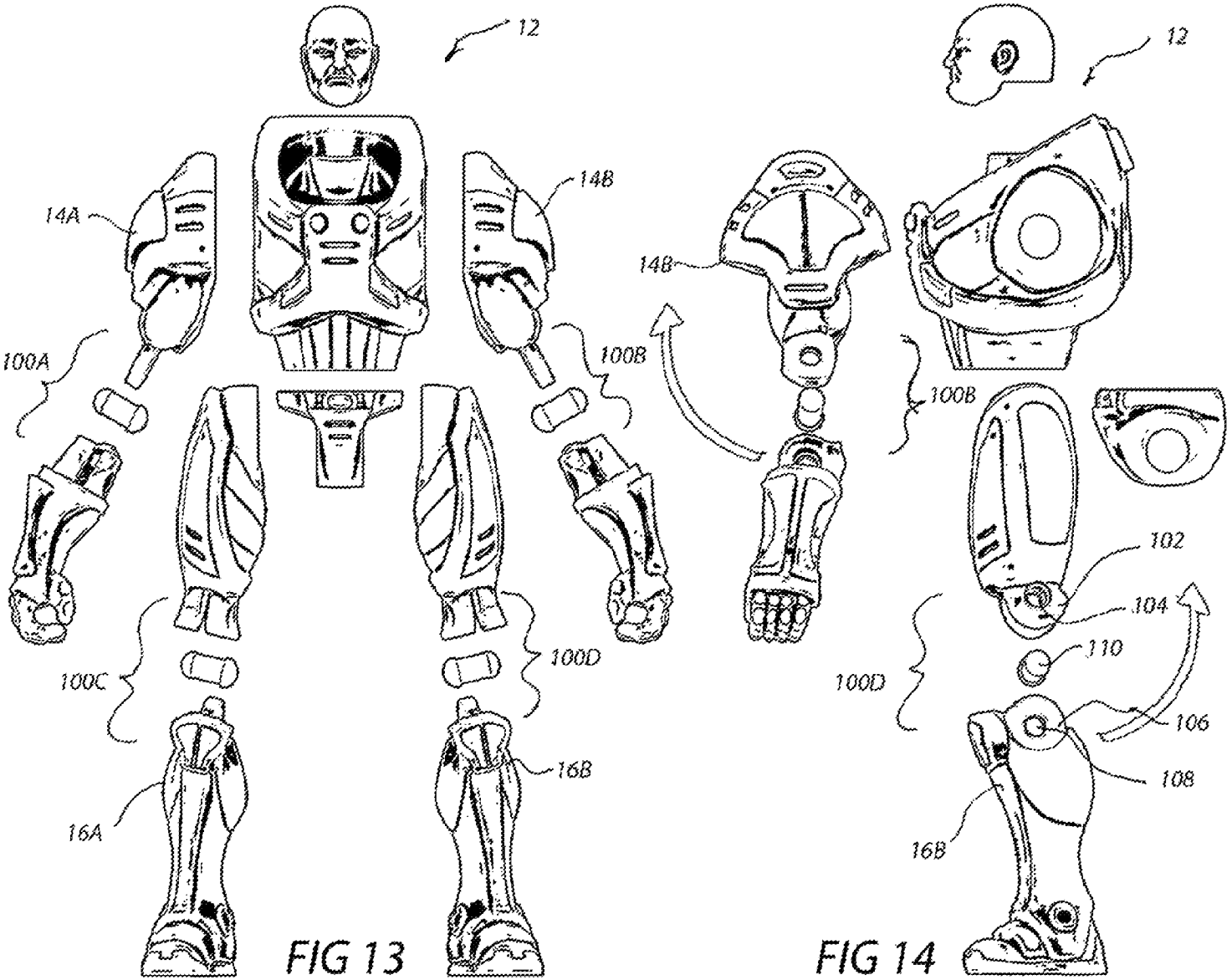
FIG. 13 is a partially exploded front elevational view of the toy action character model shown in FIG. 1 showing hinged knees and elbows.
FIG. 14 is a partially exploded side elevational view of the toy action character model shown in FIG. 13.

In other embodiments as also previously discussed, action character model 10 can be made with one or more hinge joints. For example, as depicted in FIGS. 13 and 14, arms 14A and 14B and legs 16A and 16B are each formed with a hinge 100A-110D, respectively. Each hinge 100 comprises a rounded first knuckle 102 disposed on an upper portion of an arm 14 or leg 16 and having a passage 104 extending therethrough. Each hinge 100 also includes a second knuckle 106 disposed on a lower portion of the corresponding arm 14 or leg 16 and having a passage 108 extending therethrough. In one embodiment, one of knuckles 102 and 106 can be forked so that the other knuckle can be received therebetween. During assembly, knuckles 102 and 106 are placed together so that passages 104 and 108 are aligned. A hinge pin 110 is then received and secured within aligned passages 104 and 108 so that knuckles 102 and 106 and thus the corresponding upper and lower portions of arms 14 and legs 16 are hingedly coupled together. Other forms of hinges can also be used and hinges can also be places at other locations such as at the wrist, elbow, shoulder, neck, stomach, waits, hip, knee, ankle or the like.

As previously discussed, action character model 10 can come in an infinite number of different configurations and can be used with an infinite number of replaceable parts having different configurations. An "action character model" or "toy action character model" as used herein references a model of an action character that is depicted as living. In contrast, an "action character accessory" or "toy action character accessory" as used herein references an object that is depicted as inanimate and may or may not be used by an action character model but which is separate from an action character model. Examples of action character accessories include, but are not limited to, vehicles; such as, spaceships, aircraft, ground vehicles, and water vehicles; weapons; equipment; armor; buildings; clothing; structures and the like. An "action character assembly" or "toy action character assembly" as used herein references both action character models and action character accessories.

Figure 15:
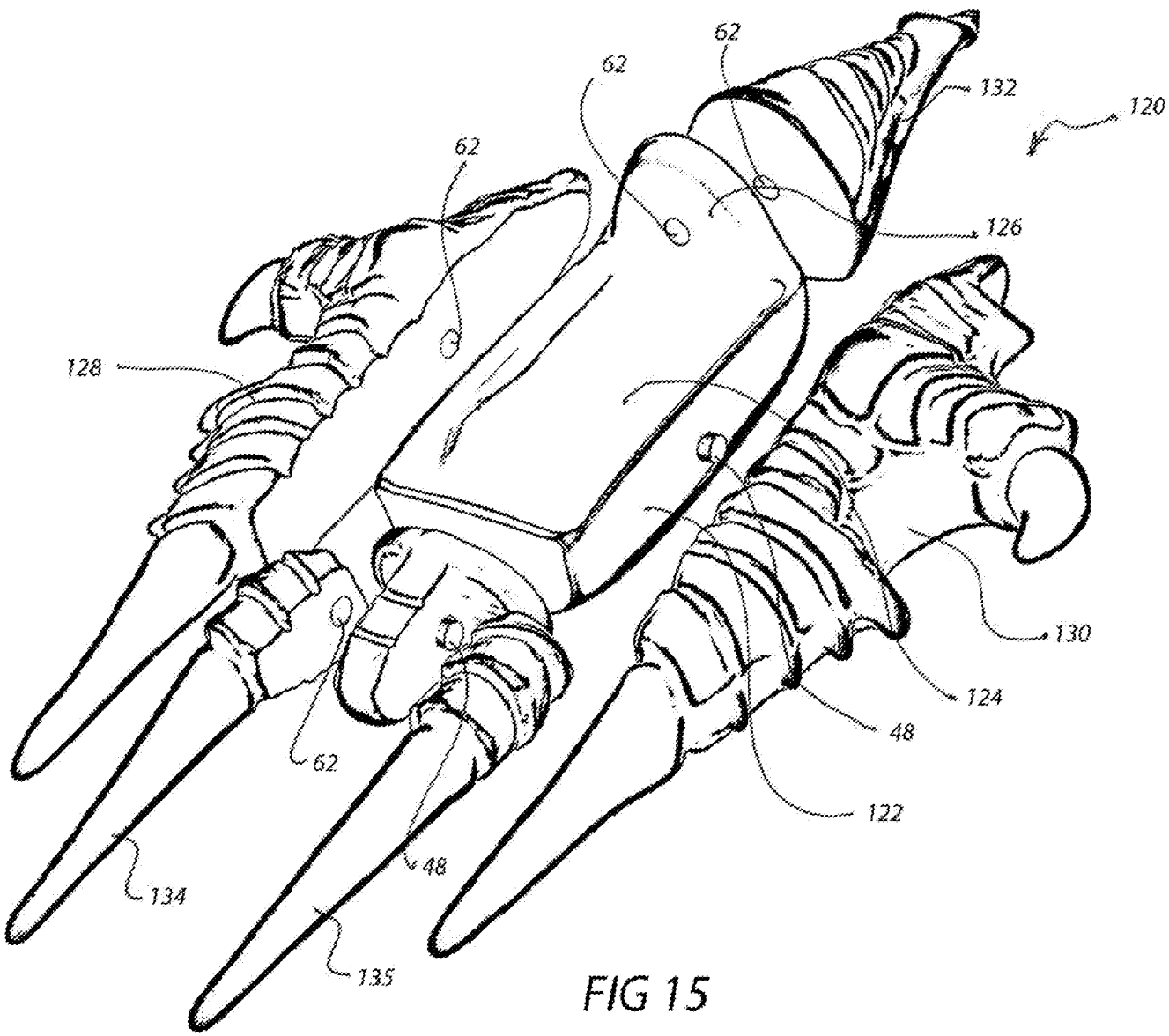
FIG. 15 is a partially exploded perspective view of a toy action character accessory.
Figure 17:
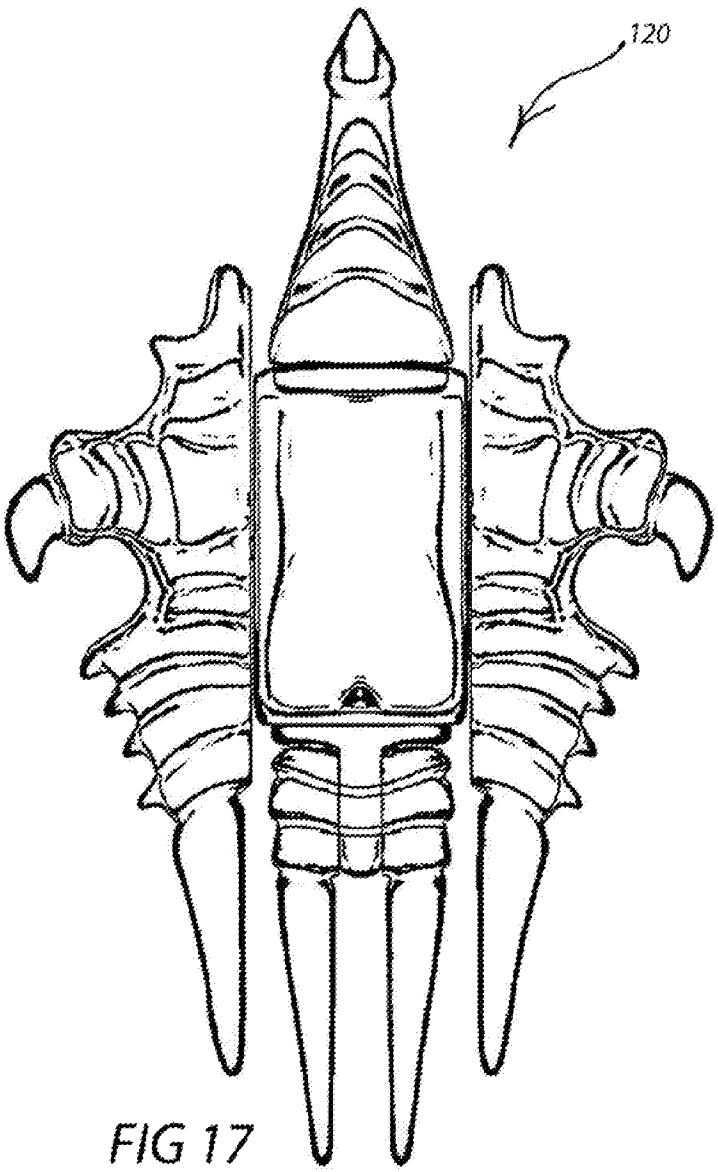
FIG. 17 is top plan view of the assembled toy action character accessory shown in FIG. 15.
Figure 16:
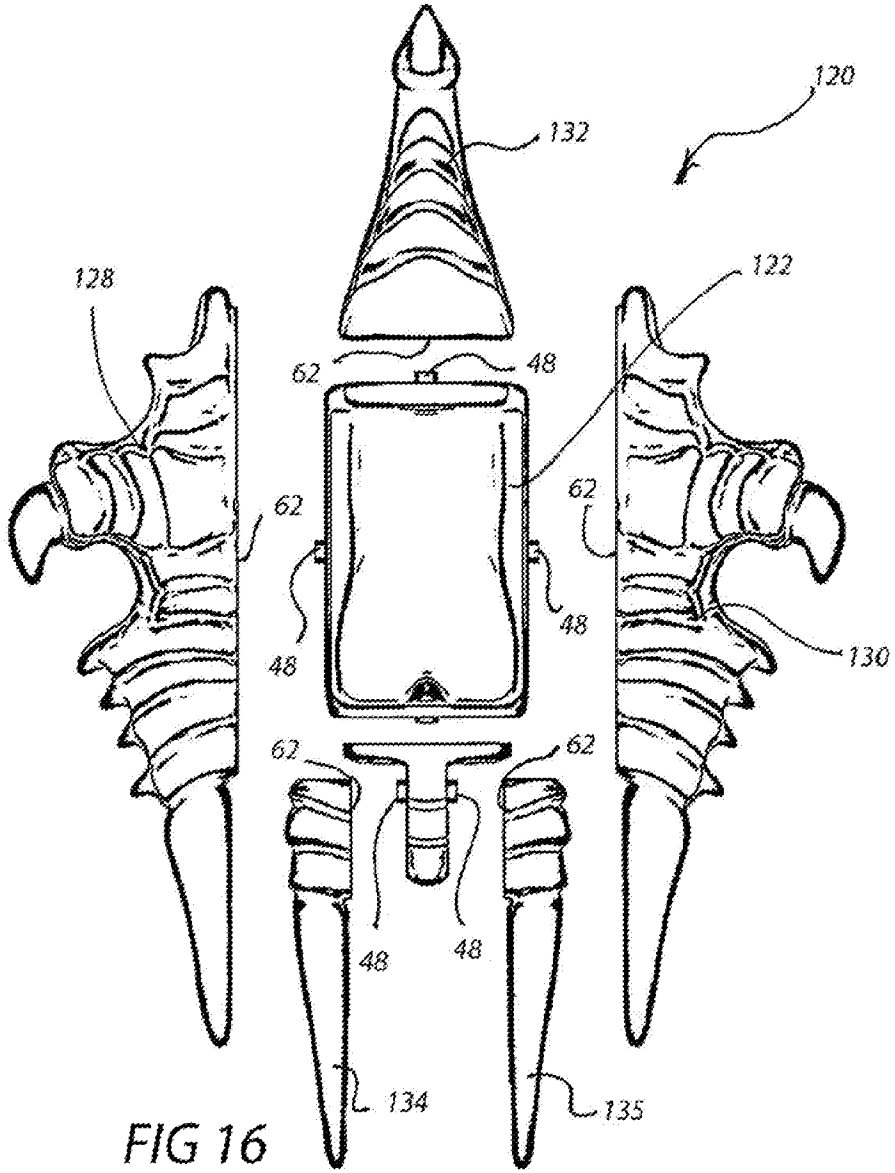
FIG. 16 is a partially exploded top plan view of the toy action character accessory shown in FIG. 15.

Depicted in FIGS. 15-17 is one embodiment of an action character accessory 120 which is in the form of an aircraft that could be ridden by action character model 10. Like elements between action character model 10 and action character accessory 120 are identified by like reference characters. A depicted in the figures, action character assembly 120 comprises a body 122 having a seat 124 and a backrest 126. Disposed on opposing sides of body 122 are wings 128 and 130. A tail 132 attaches to a rear end of body 122 while a pair of guns 134 and 135 project from a front end of body 122. Wings 128 and 130, tail 132, and guns 134 and 135 are attached to body 122 using engaging portions 48 that project from body 122 and recessed sockets 62 formed on wings 128, 130, tail 132, and guns 134 and 135 which received engaging portions 48.

More specifically, engaging portions 48 project from body 120 and comprise either a magnet 40 or the combination of a magnet 40 and retainer 80, as previously discussed with regard to action character model 10. Likewise, a magnet 60 is disposed within each of wings 128 and 130, tail 132, and guns 134 and 135 so as to be adjacent to recessed sockets 62. As previously discussed, a retainer 80 can be used to secure magnet 60 adjacent to recessed socket 62. Accordingly, when engaging portions 48 are received within recessed sockets 62, a magnetic coupling and an optional lite friction fit engagement is produced so as to secure wings 128, 130, tail 132, and guns 134 and 135 to body 122 but still enables wings 128, 130, tail 132, and guns 134 and 135 to independently rotate relative to body 122. All the previously discussions, dimensions, alternatives, workings and operation discussed or relating to openings for receiving magnets 40, 60, engaging portions 48, magnets 40, 60, recessed sockets 62, and retainers 80 discussed with regard to action character model 10 are also applicable to action character accessory 120.

It is appreciated that any number of different engaging portions 48 and recess socket 62 with corresponding magnets 40, 60 can be formed on action character accessory 120 and that any number of different parts of different configurations can be exchanged. As with action character model 10, the different parts of action character accessory 120 are typically made of a polymer to which retainers 80 can be welded. In another embodiment, all of magnets 40 or magnets 60 could be replaced with a disc of corresponding size that is made from a material that is non-magnetic but that is attracted to a magnet. Examples of such materials are discussed below. In this embodiment, the non-magnetic disc would magnetically couple with the remaining magnets 40 or magnets 60.

Figure 18:
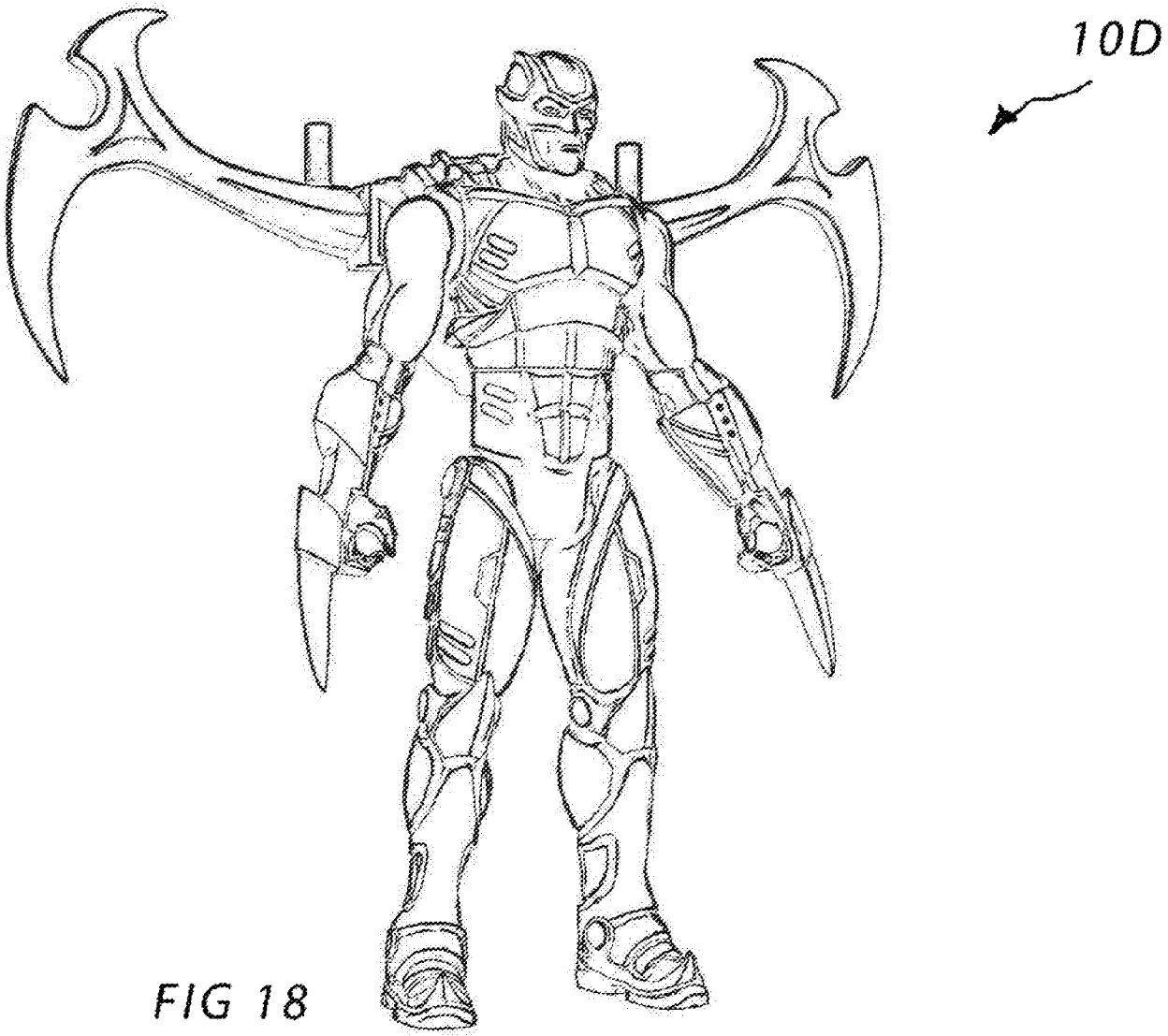
FIG. 18 is a perspective view of an alternative embodiment of an action character model.
Figure 19:
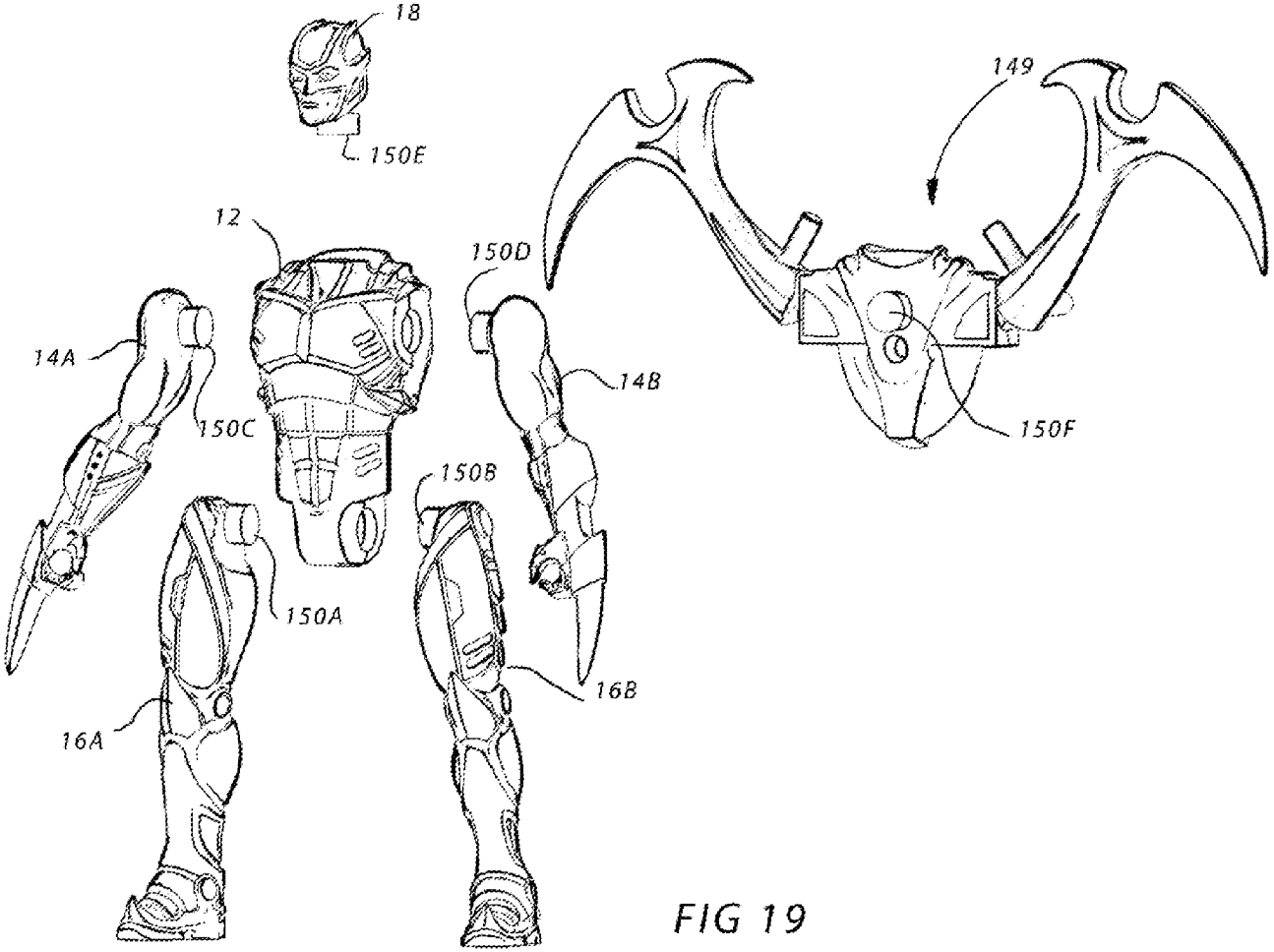
FIG. 19 is a partially exploded view of the action character model shown in FIG. 18.

Depicted in FIG. 18 is an alternative embodiment of an inventive action character model 10D incorporating features of the present invention. Like elements and features between action character model 10A and 10D are identified by like reference characters. Furthermore, alternatives, features, and modifications discussed above with regard to action character model 10A are also applicable to action character model 10D. As depicted in FIG. 19, action character model 10D comprises torso 12 to which a plurality of appendages can be removably attached. Examples of appendages include arms 14, legs 16, head 18 or an accessory 149. The appendages are rotatably attached to torso 12 and are secured thereto by magnet coupling. However, in contrast to action character model 10A where magnets were placed both within torso 12 and in each of the appendages, in action character model 10D non-magnetic connectors 150 are secured to each of the appendages for use in removably magnetically coupling the appendages to torso 12.

Figure 20:
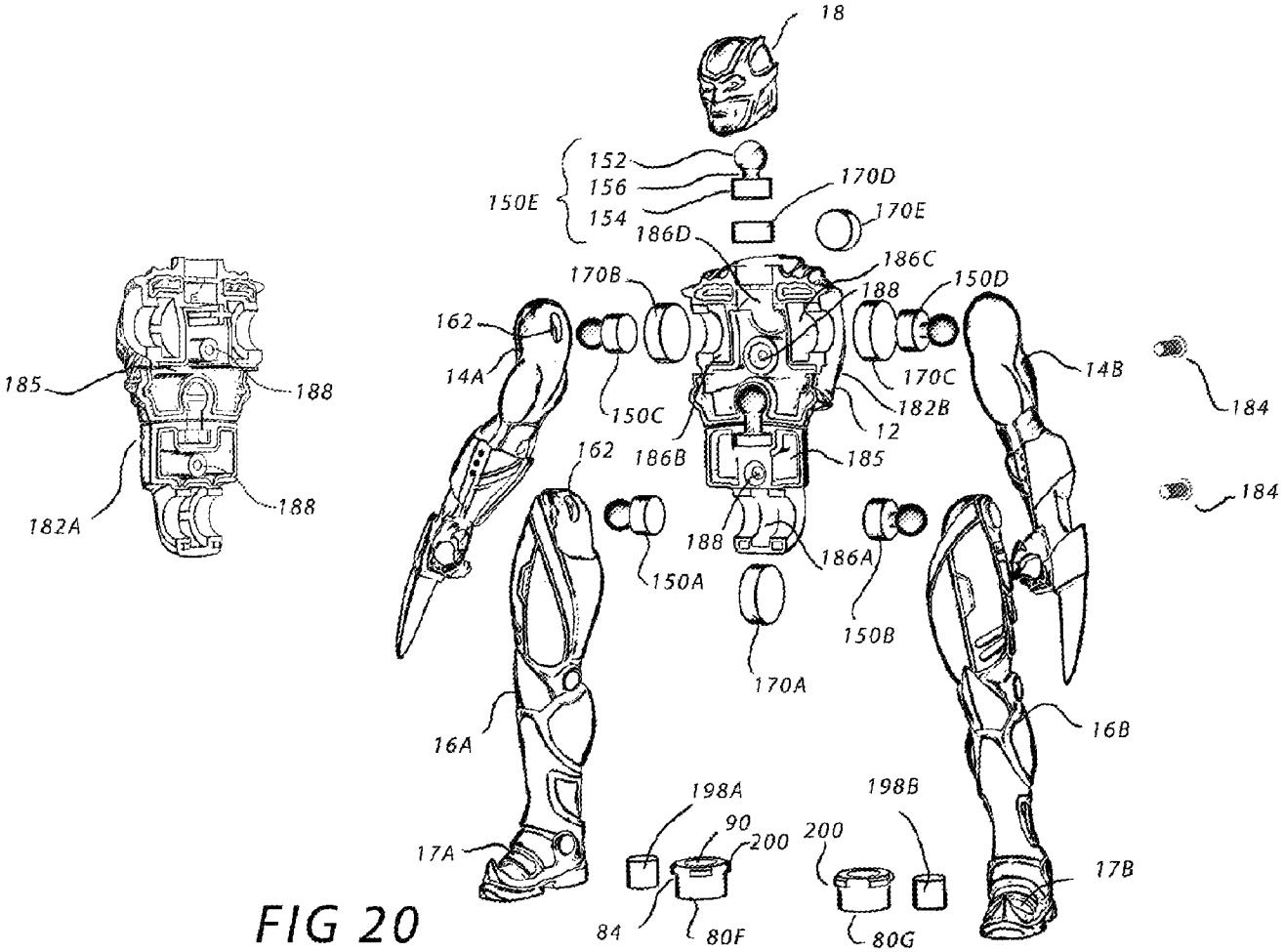
FIG. 20 is a further exploded view of the action character model shown in FIG. 19.

As depicted in FIG. 20 each connector 150 comprises a rounded head 152, a disc 154 and a neck 156 that extends between head 152 and disc 154. Rounded head 152 is typically spherical or substantially spherical. Disc 154 can be cylindrical having opposing flat end faces. Disc 154 can be the same dimensions and configuration as magnets 40 and 60 as previously discussed. Neck 156 is constricted relative to rounded head 152 and disc 154 and thus has a smaller diameter. In one embodiment, connector 150 is non-magnetic, i.e., made from a non-magnetic material, but is made from a material that is attracted to a magnet. For example, connector 150 can be comprised of iron, nickel or cobalt, which are attracted to magnets, or any material that includes one or more of the foregoing metals, such as steel. Connector 150 typically comprises a metal or metal alloy that is attracted to a magnet but can also comprise a composite. For example, the composite could comprise a non-metal material such as a polymer, resin, adhesive, fiber matrix or the like combined with a material that is attracted to magnets. It is appreciated that the materials for connector 150 may magnetize slightly when placed in a magnetic field but materials with such slight magnetism are herein considered as non-magnetic.

Figure 21:
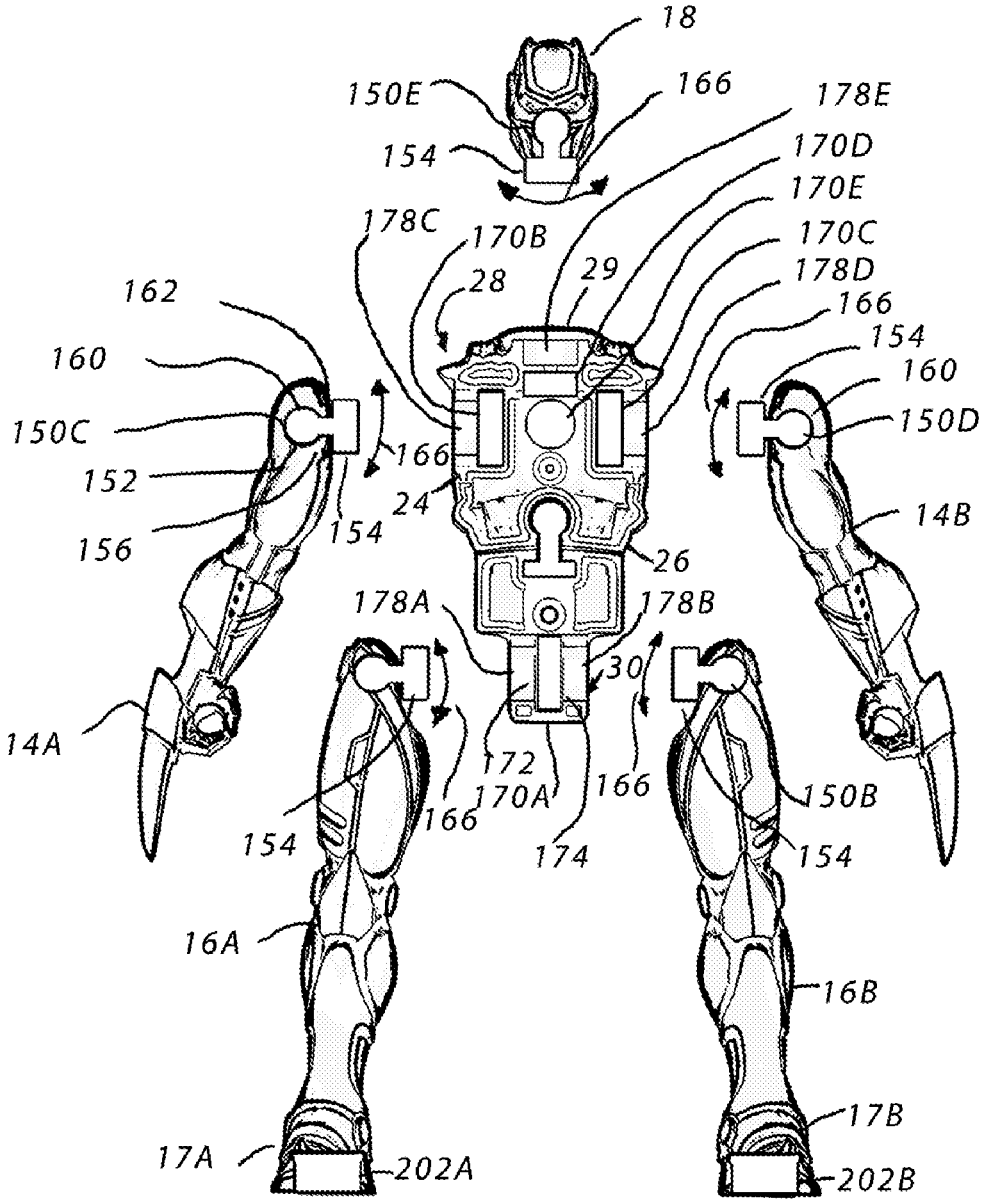
FIG. 21 is an elevated front view of the action character model shown in FIG. 18 showing the connectors and magnets within the torso and the appendages.

As previously discussed, each of the appendages is typically molded from a polymeric material. As depicted in FIG. 21, each appendage has a rounded socket 160 in which rounded head 152 is received and an opening 162 (FIG. 20) that extends between socket 160 and the exterior surface of the corresponding appendage. Neck 156 passes through opening 162 so that disc 154 is disposed outside of the appendage. Opening 162 is constricted or narrowed relative to socket 160 so that rounded head 152 is captured within socket 160 and cannot freely pass out through opening 162. However, opening 162 is also typically larger than the diameter of neck 156. As a result, connector 150 is pivotably mounted on the appendages by rounded head 152 rotating within socket 160 and neck 156 laterally moving within opening 162. For example, as depicted in FIG. 20, openings 162 can be elongated so that connectors 150 can pivot back-and-forth along arrows 166 as shown in FIG. 21. It is appreciated that openings 162 can be formed having a variety of different shapes and configuration to enable pivoting of connectors 150 in a variety of different directions.

In one method of manufacture, the appendages can be molded having socket 160 and opening 162 formed thereon. Rounded head 152 of connector 150 can then be press fit into socket 160 through opening 162, such as when the molded polymer is still warm and thus resiliently pliable. As the polymer cools, the polymer become more rigid, thereby preventing rounded head 152 from being pulled out of socket 160. This method of manufacture has the advantage that it is simple and eliminates the need for complex over molding or the use of an adhesive.

Returning to FIG. 21, torso 12 is shown having five magnets 170A-170E secured therein. Magnets 170A-E are disc magnets, as previously discussed, having a cylindrical sidewall that extends between a first side 172 and an opposing second side 174. A first magnet 170A is centrally located at lower end 30 of torso 12. A second magnet 170B is located at upper end 28 toward right side 24. A third magnet 170C is located at upper end 28 toward left side 26. A fourth magnet 170D is centrally located at upper end 28 toward top face 29. Finally, a fifth magnet 170E is centrally located at upper end 28 below magnet 170D and faces toward the back of torso 12.

A first passage 178A extends from the exterior surface of torso 12 at lower end 30 of right side 24 to first side 172 of magnet 170A. A second passage 178B extends from the exterior surface of torso 12 at lower end 30 of left side 26 to second side 174 of magnet 170A. A third passage 178C extends from the exterior surface of torso 12 at upper end 28 of right side 24 to first side 172 of magnet 170B. A fourth passage 178D extends from the exterior surface of torso 12 at upper end 28 of left side 26 to second side 174 of magnet 170C. A fifth passage 178E extends from the exterior surface of torso 12 at top face 29 to magnet 170D. A sixth passage extends centrally into the back of torso 12 to magnet 170E.

Each passage 178 typically has a cylindrical configuration in which disc 154 of connector 150 can be received and selectively rotated. Specifically, disc 154 of connector 150A on right leg 16A is removably received within passage 178A so that connector 150A is magnetically coupled to first magnet 170A. As such, right leg 16A is magnetically coupled to torso 12. Disc 154 of connector 150B on left leg 16B is removably received within passage 178B so that connector 150B is magnetically coupled to first magnet 170A. As such, left leg 16B is magnetically coupled to torso 12. Disc 154 of connector 150C on right arm 14A is removably received within passage 178C so that connector 150C is magnetically coupled to second magnet 170B. As such, right arm 14A is magnetically coupled to torso 12. Disc 154 of connector 150D on left arm 14B is removably received within passage 178C so that connector 150D is magnetically coupled to third magnet 170C. As such, left arm 14A is magnetically coupled to torso 12. Disc 154 of connector 150E on head 18 is removably received within passage 178E so that connector 150E is magnetically coupled to fourth magnet 170D. As such, head 18 is magnetically coupled to torso 12. Disc 154 of connector 150F on accessory 149 (FIG. 19) is removably received within the passage on the back of torso 12 so that connector 150F is magnetically coupled to fifth magnet 170E. As such, accessory 149 is magnetically coupled to torso 12.

In view of the foregoing, arms 14, legs 16, head 18, and accessory 149 can be removably attached to torso 12 by magnetic coupling. As desired and as previously discussed, the appendages can be selectively removed and switched locations and/or replaced with appendages of other configurations. When the appendages are attached, they can be freely rotated because of discs 154 rotating within passages 170. In addition, the appendages can rotate about rounded head 152 of connectors 150. Furthermore, as discussed above, the appendages can pivot on connectors 150.

Figure 22:
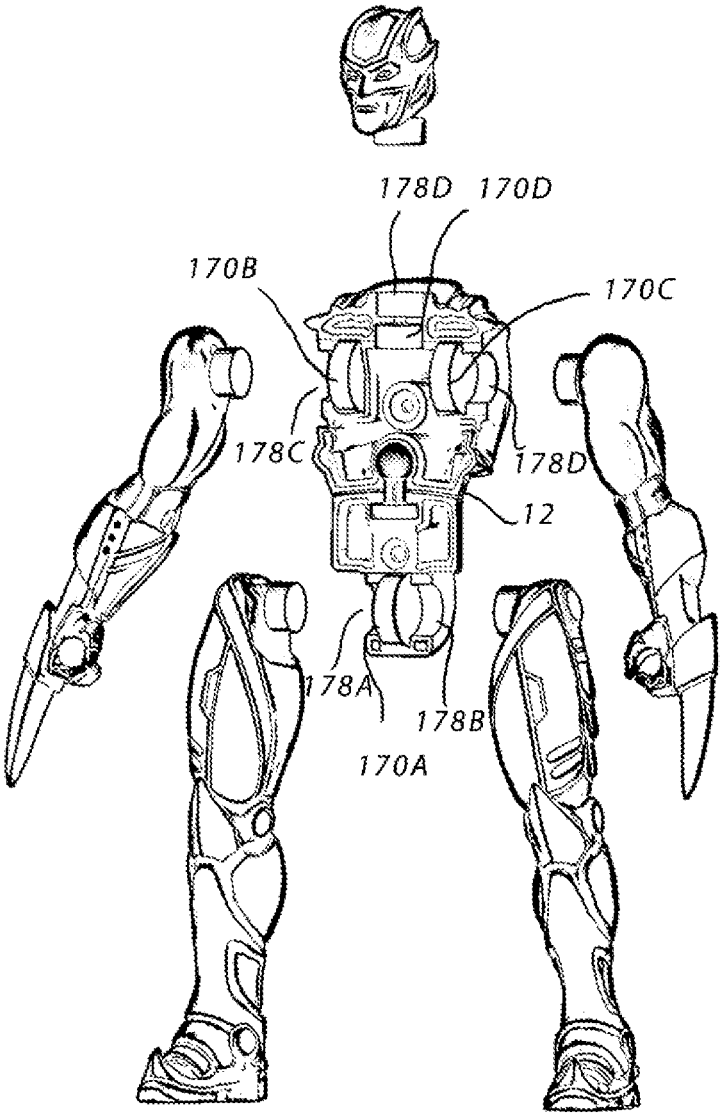
FIG. 22 is a perspective view of the action character model shown in FIG. 20 having the magnets captured within the torso.

As depicted in FIG. 20, torso 12 comprises a first portion 182A and a second portion 182B that are selectively secured together by fasteners 184. More specifically, first portion 182A can comprise a front half of torso 12 and second portion 182B can comprise a back half of torso 12. Fasteners 184 can comprise screws, rivets, snap-fit connections, press-fit connections or other conventional connectors that secure portions 180A and 180B together. FIG. 20 shows that first portion 180A and second portion 180B each have an interior surface 185 having complementary recesses 186A, 186B, 186C and 186D. Recesses 186A-D are configured to received and capture magnets 170A-D, respectively, as portions 180A and 180B are mated together. Passages 178 (FIG. 20) are smaller than the combined recesses 186 and are also smaller than magnets 170 so that magnets 170 captured within recesses 186 (FIG. 22) cannot unintentionally pass out through passages 178. In this configuration, it is noted that magnets 170 are larger than discs 154 of connectors 150, i.e., magnets 170 have a larger diameter. Openings 188 can be formed through portion 180B and into portion 180A to receive fasteners 184 and permit coupling of portions 180A and 180B together.

The above configuration has a number of unique advantage. For example, torso 12 can be easily assembled by simply capturing magnets 170 between portions 180 and then securing portions 180 together by fasteners 190. This configuration eliminates the need for complex over molding and eliminates the need for adhesive. Furthermore, magnets 170 are well secured within torso 12 so that there is little chance that they could be separated, thereby decreasing the risk that magnets could be swallowed by small children. In addition, by having the magnets within torso 12 and having connectors 150 be non-magnetic and secured to the appendages, there is no concern with matching polarities of magnets. That is, magnets can be placed in either orientation 170 within torso 12 and any appendage can be secured within any passage 178 formed on torso 12. In addition, because connectors 150 are non-magnetic, there is less concern if a connector 150 is separated from an appendage and swallowed by a child.

Figure 23:
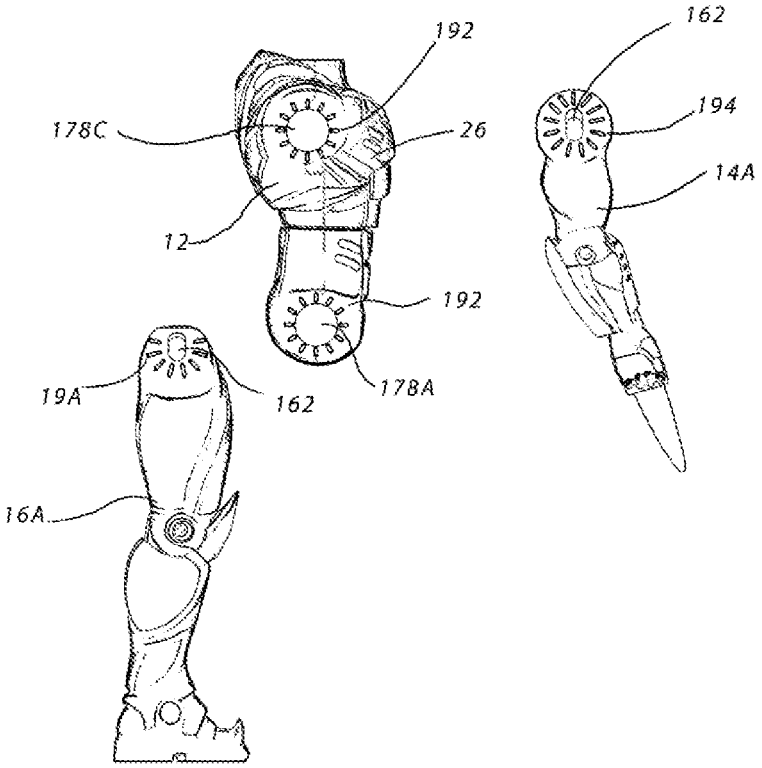
FIG. 23 is an elevated right side view of an alternative embodiment of the torso, arm, and leg of the action character model shown in FIG. 18.

In some embodiments, it can be desirable to enhance the engagement between torso 12 and one or more of the appendages. For example, if the magnetic strength between magnets 170 and connectors 150 is not sufficiently strong, a raised appendages may self-rotate or move under for force of gravity, thereby limiting the ability to pose and support action character model 10B in desired configurations and orientations. To address this issue, as depicted in FIG. 23, ribs 192 are formed on exterior surface of torso 12 so as to radially outwardly project from passages 178A and 178C Likewise, ribs 194 are formed on the exterior surface of arm 14A and leg 16A so as to radially outwardly project from opening 162 or connectors 150 that attach thereto.

Accordingly, when arm 14A and leg 16A are magnetically coupled with torso 12, as discussed above, ribs 192 and 194 mesh together, like interlocking gears, which assists in restraining arm 14A and leg 16A in a desired orientation or position on torso 12. However, when a manual force is applied to rotate arm 14A or leg 16A, ribs 192 and 194 ride over each other. This enables arm 14A and leg 16A to be indexed to a new orientation, without separating arm 14A or leg 16A from torso 12, where they are again restrained in place by meshed ribs 192 and 194.

It is appreciated that ribs 192 and 194 can be applied in a variety of different configurations. For example, a plurality of radially spaced apart ribs 194 can be formed on the appendages, such as at least 4, 6, 8, 10, or 12, while only one or two ribs 192 may need to be formed on torso 12. The opposite configuration can also be used. Furthermore, ribs 192 and 194 could be formed outwardly projecting from the exterior surface of torso 12 and the appendages. In another embodiment, however, the ribs could outwardly project from one of torso 12 or the appendages and the ribs on the other of torso 12 or appendage could be recessed into the exterior surface, such as by forming radial slots on the exterior surface. The ribs would thus interlock within the slots.

Furthermore, ribs 192 and 194 are only one example of a detent that can be used for indexing appendages on torso 12. It is appreciated that as variety of other detent configurations can also be used. For example, a plurality of recesses, such as semi-circular recesses, could be formed on one of torso 12 or the appendages and one or more projections, such as hemi-spherical projections, could be formed on the exterior surface of the other of the torso 12 or the appendages. Other detent configurations can also be used. Although the above on discusses detents used between torso 12, arm 14A and leg 16A, it is appreciated that the same detents can also be used to assist in engages all of the appendages to torso 12.

Figure 24:
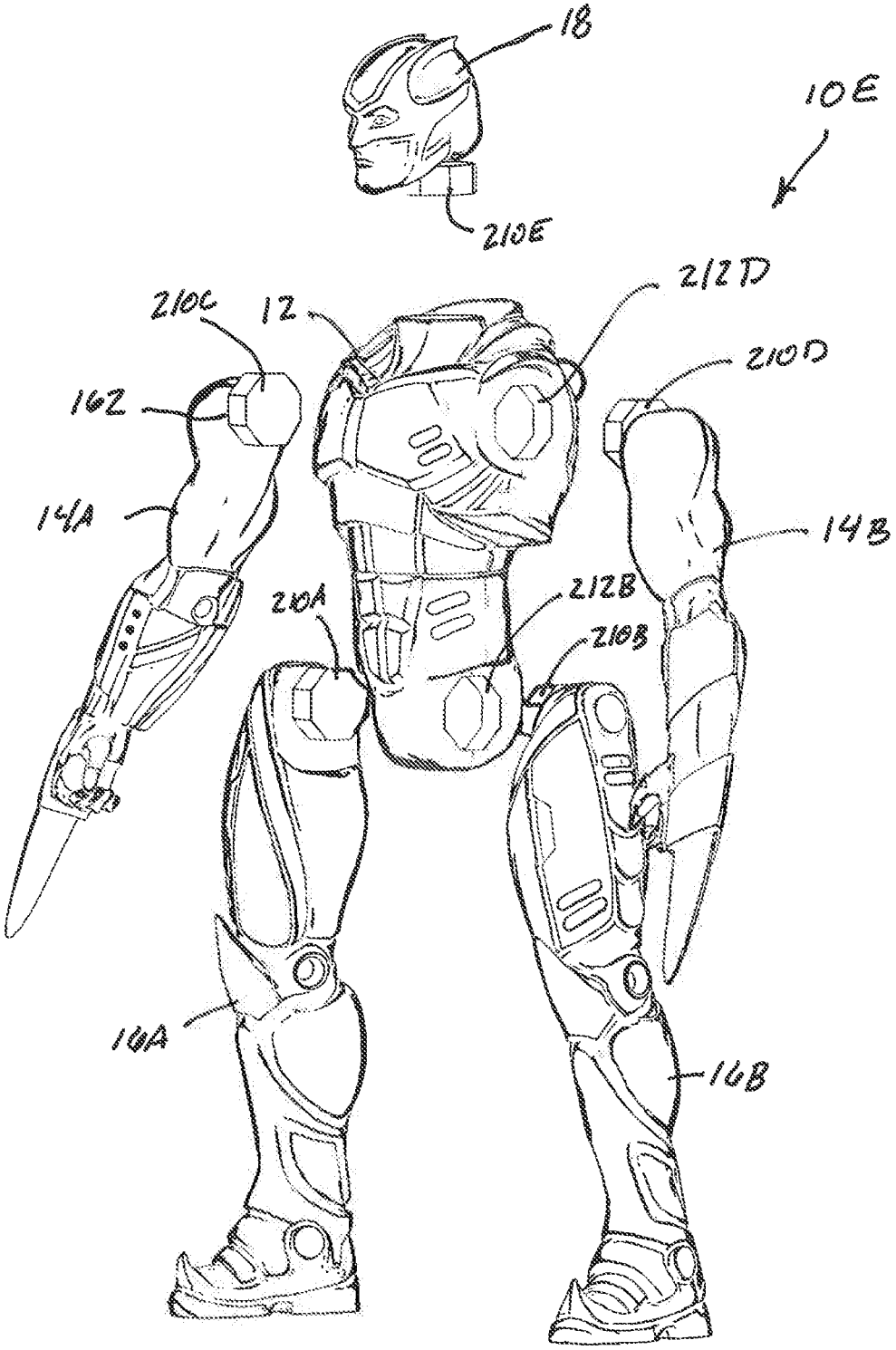
FIG. 24 is a partially exploded view of a further alternative embodiment of an action character.
Figure 25:
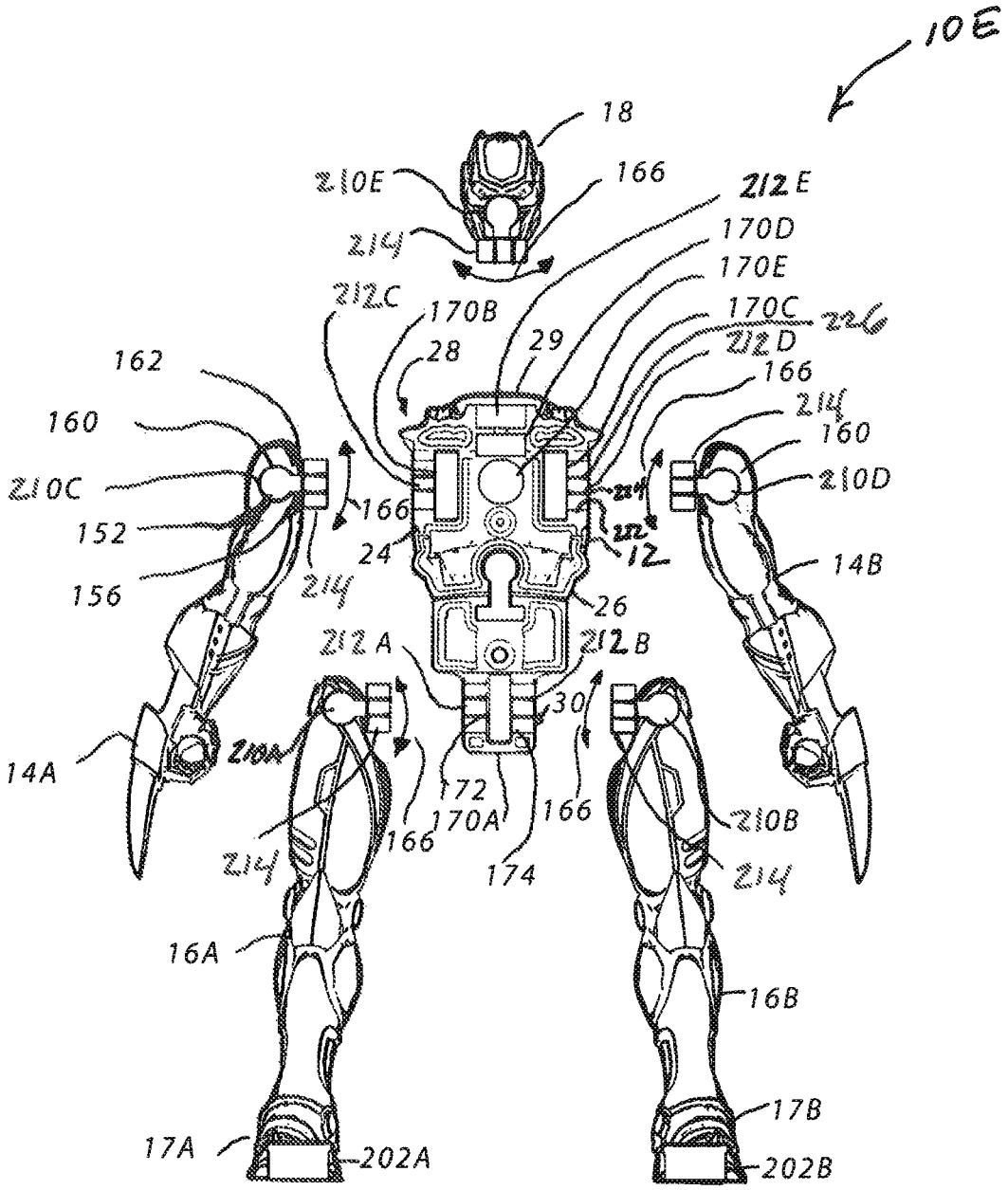
FIG. 25 is an elevated front view of the action character model shown in FIG. 24 showing the connectors and magnets within the torso and the appendages.

Depicted in FIGS. 24 and 25 is another alternative embodiment of an inventive action character model 10E incorporating features of the present invention. Like elements and features between action character model 10D and 10E are identified by like reference characters. Furthermore, alternatives, features, and modifications discussed above with regard to action character model 10D are also applicable to action character model 10E. As depicted in FIGS. 24 and 25, action character model 10E is the same as action character 10D except for two differences. Specifically, connectors 150 (FIG. 20) have been replaced with connectors 210 (more specifically, connectors 150A-150E have been replaced with connectors 210A-210E, respectively) and passages 178 (FIG. 21) on torso 12 have been replaced with passages 212 (more specifically, passages 178A-178E have been replaced with passages 212A-212E, respectively).

Figure 26:
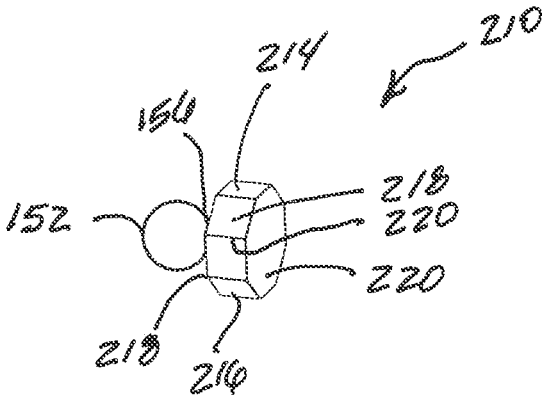
FIG. 26 is a perspective view of the connector shown in FIG. 25.
Figure 27:
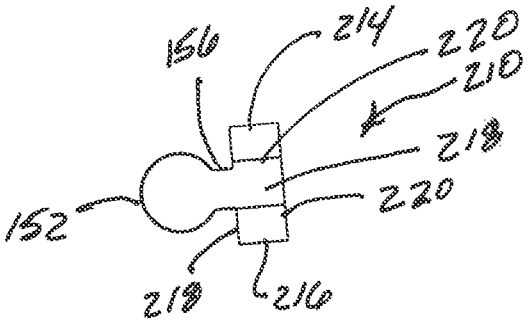
FIG. 27 is an elevated side view of the connector shown in FIG. 26.

As previously discussed with regard to FIG. 20, each connector 150 comprises rounded head 152, disc 154 and neck 156 that extends between head 152 and disc 154. In contrast, as depicted in FIGS. 26 and 27, each connector 210 comprises rounded head 152, a disc 214 and neck 156 that extends between head 152 and disc 214. Although head 152 and neck 156 are the same between connectors 150 and 210, disc 214 differs from disc 154. Specifically, whereas disc 154 is cylindrical, i.e., has a circular transverse cross sectional configuration, disc 214 has a non-circular transverse cross sectional configuration. That is, disc 214 has an encircling sidewall 216 that extends between opposing end faces 218 and 220. In one embodiment, sidewall 216 is comprised of a plurality of flat faces 218 that are separated by corners 220. In one embodiment, the number of flat faces 218 can be at least 3, 4, 5, 6, 7, 8, 9, 10 or in a range between any two of the foregoing numbers. Expressed in other terms, sidewall 216 can have a polygonal transverse cross sectional configuration such as triangular, square, pentagonal, septagonal, octagonal or have other polygonal configurations. In still other embodiments, sidewall 216 can have a transverse cross sectional configuration having other non-circular configurations such as oval, elliptical, or irregular.

Each connector 210 can be made of the same materials as connector 150. e.g., a non-magnetic material or a magnetic material. Each connector 210 can also be pivotably connected to each appendage 14, 16, and 18 (FIGS. 24 and 25) in the same way that connectors 150 are pivotably connected to the appendages. For example, as previously discussed, each of the appendages is typically molded from a polymeric material. As depicted in FIG. 25, each appendage has a rounded socket 160 in which rounded head 152 is received and an opening 162 (FIG. 20) that extends between socket 160 and the exterior surface of the corresponding appendage. Neck 156 of each connector 210 passes through opening 162 so that disc 214 is disposed outside of the appendage, as shown in FIGS. 24 and 25. Opening 162 (FIGS. 20 and 25) is constricted or narrowed relative to socket 160 so that rounded head 152 of connector 210 is captured within socket 160 and cannot freely pass out through opening 162. However, opening 162 is also typically larger than the diameter of neck 156 of connector 210. As a result, connector 210 is pivotably mounted on the appendages by rounded head 152 rotating within socket 160 and neck 156 laterally or otherwise moving within opening 162.

As discussed above, the second distinction between action character model 10D and 10E is that passages 178 on torso 12 of action character model 10D (FIG. 21) have been replaced with passages 212 on torso 12 FIGS. 24 and 25. More specifically, whereas passage 178 typically has a cylindrical configuration in which disc 154 of connector 150 can be received and selectively rotated (FIG. 21), in one embodiment each passage 212 has a configuration that is complementary to the non-circular configuration of disc 214 so that when disc 214 is received within passage 212, disc 214 cannot freely rotate within passage 212. For example, passage 212 is bounded by an interior wall 222 that can comprise of flat faces 224 that are separated by corners 226. In one embodiment, the number of flat faces 224 can be at least 3, 4, 5, 6, 7, 8, 9, 10 or in a range between any two of the foregoing numbers. Expressed in other terms, each passage 212 can have a polygonal transverse cross sectional configuration such as triangular, square, pentagonal, septagonal, octagonal or have other polygonal configurations that are configured to receive disc 214 to prevent free rotation of disc 214 therein. In still other embodiments, passage 212 can have a transverse cross sectional configuration having other non-circular configurations such as oval, elliptical, or irregular.

Typically, each passage 212 is configured to snugly receive disc 214 in a close tolerance fit to both restrain rotation of disc 214 within passage 212 and to help prevent unwanted removal of disc 214 from passage 212. In one embodiment, passage 212 is configured so that when disc 214 is received within passage 212, disc 214 cannot rotate within passage 212 by more than 10°, 7°, 5°, 2° or 1°. However, disc 214 can still be repeatedly removed from and inserted back into passage 212 and, in some embodiments, disc 214 can be repeatedly removed from passage 212 and inserted back into passage 212 at a different orientation.

Action character model 10E still has many of the same benefits as discussed above with regard to action character model 10D. However, action character model 10E has the added benefits of limiting or precluding unwanted rotation of appendages by disc 214 rotating within passage 212, i.e., rotation of the appendages is now limited to the appendage rotating about head 152 of connectors 210. Furthermore, action character model 10E helps limited unwanted separation of appendages from torso 12 by more snugly holding disc 214 within passage 212. Except for the above modifications of action character model 10E, the previously discussed configuration, assembly, use, and alternatives of action character model 10D are also applicable to action character model 10E. Returning to FIG. 20, each leg 16A and 16B has a corresponding foot 17A and 17B, respectively. In one embodiment, it can be desired to insert a magnet 198, such as a disc magnet, within each foot 17. Magnets 198 assist in weighting feet 17 so that action character model 10B is more stable. Furthermore, by having magnets within feet 17, feet 17 can be magnetically coupled to surfaces that are attracted to magnets 198, such as steel surfaces. In one embodiment, magnets 198 can simply be over molded into feet 17. In the depicted embodiment, however, magnets 198A and 198B are secured to feet 17 by retainers 80F and 80G, respectively. Like elements and features between retainer 80 and retainers 80F and 80G are identified by like reference characters. Retainers 80F and 80G are identical to retainer 80 except that retainers 80F and 80G each include a retention lip 200 that radially outwardly projects from first end 84.

As depicted in FIG. 21, each foot 17A and 17B has a socket 202A and 202B recessed therein, respectively, which is open at the sole of feet 17A and 17B. During assembly, magnets 198A and B are placed within opening 90 of corresponding retainers 80F and 80G. The combined retainers 80F and 80G and magnets 198A and 198B are then press fit into corresponding sockets 202A and 202B. Retention lips 200 engage the interior surface of feet 17 so as to securely lock retainers 80F and 80G within socket 202A and 202B, respectively, thereby securing magnets 198A and 198B within feet 17A and 17B, respectively.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. An action character assembly comprising:

a torso having a first magnet disposed therein, the torso bounding a first passage extending from an exterior surface of the torso toward the first magnet, the first passage having a non-circular transverse cross sectional configuration; and a first appendage having a first connector attached thereto, a portion of the first connector being received within the first passage so that the first connector is magnetically coupled to the first magnet, the first connector being pivotably coupled to the first appendage.

2. The action character assembly as recited in claim 1, wherein the first connector comprises a disc being received within the first passage of the torso, the disc having a non-circular transverse cross sectional configuration.

3. The action character assembly as recited in claim 2, wherein the first passage and the disc have complementary transverse cross sectional configurations.

4. The action character assembly as recited in claim 2, wherein the first passage and the disc both have polygonal transverse cross sectional configurations.

5. The action character assembly as recited in claim 1, wherein the first connector comprises a rounded head secured to the first appendage.

6. The action character assembly as recited in claim 5, wherein the rounded head is press fit into the first appendage.

7. The action character assembly as recited in claim 1, wherein the first connector comprises:

a rounded head secured to the first appendage;

a disc being received within the first passage of the torso; and a neck extending between the rounded head and the disc, the neck having a small diameter than the rounded head or the disc.

8. The action character assembly as recited in claim 7, wherein the first appendage includes:

a socket in which the rounded head of the first connector is received; and a passage that extends between the socket and an exterior surface of the appendage, the passage being larger than the neck of the first connector so that the first connector can pivot relative to the first appendage.

9. The action character model as recited in claim 1, wherein the first connector is non-magnetic but is magnetically attracted to the first magnet.

10. The action character model as recited in claim 1, further comprising:

a second magnet disposed within the torso and spaced apart from the first magnet, a second passage extending from the exterior surface of the torso toward the second magnet; and a second appendage having a second connector attached thereto, a portion of the second connector being received within the second passage so that the second connector is magnetically coupled to the second magnet.

11. The action character model as recited in claim 1, wherein the first magnet has a cylindrical configuration.

12. The action character assembly as recited in claim 1, wherein the torso comprises a first portion and a second portion that are secured together by one or more fasteners, the first magnet being captured between the first portion and the second portion.

13. The action character assembly as recited in claim 12, wherein the one or more fasteners comprise one or more screws.

14. The action character assembly as recited in claim 1, wherein the portion of the first connector is received within the first passage so that the first connector cannot freely rotate within the first passage.

15. An action character assembly comprising:

a torso having a first magnet disposed therein, the torso bounding a first passage extending from an exterior surface of the torso toward the first magnet, the first passage having a non-circular transverse cross sectional configuration; and a first appendage having a first connector attached thereto, a portion of the first connector being received within the first passage so that the first connector is magnetically coupled to the first magnet, the first connector being movably coupled to the first appendage, wherein the first connector comprises:

a rounded head secured to the first appendage;

a disc being received within the first passage of the torso; and a neck extending between the rounded head and the disc, the neck having a small diameter than the rounded head or the disc.

16. The action character assembly as recited in claim 15, wherein the first appendage includes:

a socket in which the rounded head of the first connector is received; and a passage that extends between the socket and an exterior surface of the appendage, the passage being larger than the neck of the first connector so that the first connector can pivot relative to the first appendage.

17. An action character assembly comprising:

a torso having a first magnet disposed therein, the torso bounding a first passage extending from an exterior surface of the torso toward the first magnet, the first passage having a non-circular transverse cross sectional configuration; and a first appendage having a first connector attached thereto, a portion of the first connector being received within the first passage so that the first connector is magnetically coupled to the first magnet, the first connector being movably coupled to the first appendage, wherein the torso comprises a first portion and a second portion that are secured together by one or more fasteners, the first magnet being captured between the first portion and the second portion.

18. The action character assembly as recited in claim 17, wherein the one or more fasteners comprise one or more screws.

* * * * *